US009311907B2

(12) United States Patent
Beck

(10) Patent No.: US 9,311,907 B2
(45) Date of Patent: Apr. 12, 2016

(54) MUSICAL INPUT DEVICE AND DYNAMIC THRESHOLDING

(71) Applicant: Incident Technologies, Inc., San Francisco, CA (US)

(72) Inventor: Idan Beck, San Francisco, CA (US)

(73) Assignee: INCIDENT TECHNOLOGIES, INC., San Francisco, CA (US)

( * ) Notice: Subject to any disclaimer, the term of this patent is extended or adjusted under 35 U.S.C. 154(b) by 89 days.

(21) Appl. No.: 14/216,523

(22) Filed: Mar. 17, 2014

(65) Prior Publication Data

US 2015/0262559 A1 Sep. 17, 2015

(51) Int. Cl.
*G10H 7/00* (2006.01)
*G10H 3/18* (2006.01)

(52) U.S. Cl.
CPC ..... *G10H 3/18* (2013.01)

(58) Field of Classification Search
CPC ..... G10D 1/085
USPC ..... 84/645
See application file for complete search history.

(56) References Cited

U.S. PATENT DOCUMENTS

| | | | | |
|---|---|---|---|---|
| 2,478,720 | A | | 8/1949 | Sourwine et al |
| 2,924,094 | A | | 2/1960 | Hast |
| 3,495,079 | A | | 2/1970 | Halawa et al. |
| 3,582,692 | A | | 6/1971 | Palini |
| 3,585,415 | A | | 6/1971 | Muller et al. |
| 3,673,354 | A | | 6/1972 | Oda et al. |
| 4,047,144 | A | | 9/1977 | Wong |
| 4,901,618 | A | | 2/1990 | Blum |
| 5,040,447 | A | | 8/1991 | Murata et al. |
| 5,099,742 | A | | 3/1992 | Meno |
| 5,204,670 | A | | 4/1993 | Stinton |
| 5,206,449 | A | | 4/1993 | McClish |
| 5,233,123 | A | | 8/1993 | Rose et al. |
| 5,343,793 | A | * | 9/1994 | Pattie ..... 84/454 |
| 5,557,057 | A | | 9/1996 | Starr |
| 5,777,251 | A | | 7/1998 | Hotta et al. |
| 5,929,362 | A | | 7/1999 | Oteyza |
| 6,013,923 | A | | 1/2000 | Huang |
| 6,034,316 | A | * | 3/2000 | Hoover ..... 84/738 |
| 6,162,981 | A | | 12/2000 | Newcomer et al. |
| 6,292,108 | B1 | | 9/2001 | Straser et al. |
| 6,640,644 | B1 | | 11/2003 | Mireles et al. |
| 6,800,797 | B2 | | 10/2004 | Steiger, III |
| 6,846,980 | B2 | | 1/2005 | Okulov |
| 7,220,906 | B2 | | 5/2007 | Sasaki |
| 7,241,948 | B2 | | 7/2007 | Cummings |
| 7,521,619 | B2 | | 4/2009 | Salter |
| 7,563,977 | B2 | | 7/2009 | Cummings |
| 7,598,449 | B2 | | 10/2009 | Sullivan |

(Continued)

FOREIGN PATENT DOCUMENTS

| | | | |
|---|---|---|---|
| SU | 960554 | A1 | 9/1982 |
| SU | 1430767 | A1 | 10/1988 |

*Primary Examiner* — Jianchun Qin
(74) *Attorney, Agent, or Firm* — Polsinelli PC

(57) ABSTRACT

Disclosed herein are systems, methods, and non-transitory computer-readable storage media for detecting vibrations in one or more strings of a stringed input device, detecting contact between the string and a contact in an array of contacts. The contacts detected and the vibrations can be registered, processed, and interpreted as musical notes. In some embodiments, the vibration inputs are only registered if they are intended inputs rather than inputs caused by the mechanical coupling of vibrations across the strings.

20 Claims, 34 Drawing Sheets

(56) References Cited

U.S. PATENT DOCUMENTS

| | | | | |
|---|---|---|---|---|
| 7,799,986 | B2 | 9/2010 | Ryle et al. | |
| 7,897,866 | B2 | 3/2011 | Sullivan | |
| 8,003,877 | B2 | 8/2011 | Elion | |
| 8,022,288 | B2 | 9/2011 | Sullivan | |
| 8,089,300 | B2 | 1/2012 | Redgrave | |
| 8,093,482 | B1 * | 1/2012 | Kramer et al. | 84/485 R |
| 8,097,926 | B2 | 1/2012 | De Graff et al. | |
| 2003/0101006 | A1 | 5/2003 | Mansky et al. | |
| 2004/0187673 | A1 | 9/2004 | Stevenson | |
| 2005/0126373 | A1 | 6/2005 | Ludwig | |
| 2006/0196348 | A1 | 9/2006 | Cummings | |
| 2007/0180976 | A1 | 8/2007 | Demsey et al. | |
| 2007/0227344 | A1 | 10/2007 | Ryle et al. | |
| 2007/0256540 | A1 | 11/2007 | Salter | |
| 2007/0256541 | A1 | 11/2007 | McCauley | |
| 2008/0028920 | A1 | 2/2008 | Sullivan | |
| 2008/0047416 | A1 | 2/2008 | Cummings | |
| 2008/0271594 | A1 | 11/2008 | Starr | |
| 2009/0188371 | A1 | 7/2009 | Chiu et al. | |
| 2009/0191932 | A1 | 7/2009 | Chiu et al. | |
| 2009/0314157 | A1 | 12/2009 | Sullivan | |
| 2010/0083807 | A1 | 4/2010 | Sullivan | |
| 2010/0161283 | A1 | 6/2010 | Qing et al. | |
| 2010/0313740 | A1 | 12/2010 | Ryle et al. | |
| 2012/0036982 | A1 | 2/2012 | Sullivan | |

* cited by examiner

| Rules Mode | Required Input | Corresponding Hardware | Play Incorrect Notes? |
|---|---|---|---|
| EASY | CORRECT STRING | PIEZOELECTRIC CIRCUIT | NO |
| MEDIUM | CORRECT STRING/ CORRECT FRET | PIEZOELECTRIC CIRCUIT/ SUSPENDED WIRE STRING ARRAY | NO |
| HARD | CORRECT STRING/ CORRECT FRET | PIEZOELECTRIC CIRCUIT/ SUSPENDED WIRE STRING ARRAY | YES |

FIG. 27

MUSICAL INPUT DEVICE AND DYNAMIC THRESHOLDING

BACKGROUND

1. Technical Field

The present disclosure relates to an input device and more specifically to detection and registration of inputs.

2. Introduction

Plucking a string of a stringed instrument can cause a mechanical coupling of the vibrations to the other strings. Mechanical coupling of vibrations on traditional instrument strings is not seen as a problem because the frequency of the vibrations is the same so the coupling merely results in a resonant frequency and a more full sound production. Therefore, the detection of mechanical coupling of vibrations is not necessary for traditional stringed instruments. However, in a system when mechanical coupling of string vibrations results in false inputs, mechanical coupling of vibrations needs to be accurately detected.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

As explained above, traditional stringed instruments do not need to detect mechanical coupling of vibrations. However, the input device of the present technology does not directly use the string vibrations to output notes. Rather it detects a variety of inputs including inputs on the neck comprising strings contacting frets and inputs comprising string vibration signals (e.g. using a piezoelectric sensor and detection circuitry). This approach creates a specific issue of the mechanical coupling of vibrations causing the input device to register false inputs. Accordingly, disclosed are systems, methods, and non-transitory computer-readable storage media for detecting the mechanical coupling of vibrations on a stringed input device.

Some embodiments of the present technology involve detecting vibrations in one or more strings of a stringed input device as well as detecting contact between the string and a contact in an array of contacts. The contacts detected and the vibrations can be registered, processed, and interpreted as musical notes. In some embodiments, the vibration inputs are only registered if they are intended inputs rather than inputs caused by the mechanical coupling of vibrations across the strings.

Determining whether a vibration on a string is an intended input can involve determining a thresholding ratio describing a degree to which the vibration in one string causes a vibration in every other string. Determining a thresholding ration can involve receiving an input signal representing a calibration vibration of a first string in the array of strings, receiving a plurality of cross talk calibration voltage signals representing vibration of all the other strings that are caused by mechanical coupling of the vibration of the first string with the other strings, and storing a thresholding ratio describing the degree to which the calibration vibration in the first string caused the cross talk calibration vibration in the second string.

In some embodiments of the present technology, the amplitude of vibration signals can be inspected next to an amplitude of a vibration signal of another string using the thresholding ratio to determine whether an amplitude of the additional vibration in the second string is greater than a dynamic threshold amplitude that is a function of additional amplitude of the first string and the thresholding ratio.

The input device can register vibration inputs that exceed the dynamic threshold amplitude and can pass along zero signals for those vibration inputs that fall beneath the dynamic threshold amplitude.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which:

FIG. 27 illustrates an exemplary set of rules for playing through a composition according to some embodiments of the present technology.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

The present disclosure addresses the need in the art for detecting the mechanical coupling of vibrations on a stringed input device. Accordingly, a system, method and non-transitory computer-readable media are disclosed which display note information, detect inputs, process the input signals, and produce note information from the processed input signals.

System Overview

Figure 1:
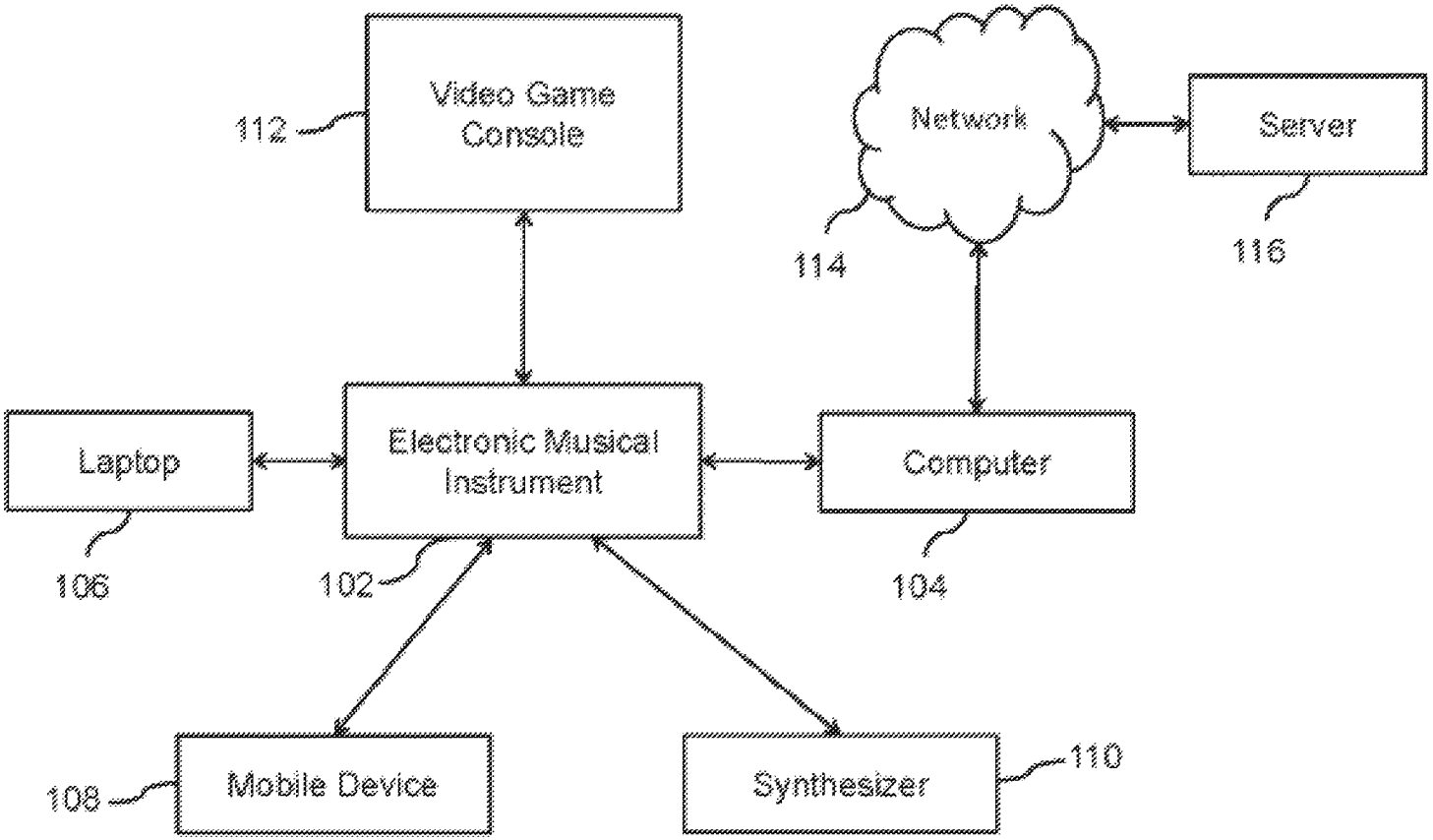
FIG. 1 illustrates an exemplary environment where various embodiments of the present technology function.

With reference to FIG. 1 an exemplary environment is illustrated where various embodiments of the invention function. A user may use an electronic input device 102 to generate electric signals. Examples of the input device 102 include, but are not limited to, input devices that look like a guitar, a violin, viola, cello or any other stringed musical instrument. The electric signals generated by the input device 102 may correspond to musical information. For example, the electric signal may include Musical Instrument Digital Interface (MIDI) signals. Furthermore, electric signals may be used to control video games. The input device 102 may communicate with various external devices through interfaces such as, but not limited to, Universal Serial Bus (USB), Recommended Standard (RS) 232, Registered Jack (RJ) 45, or other wired or wireless interfaces such as Bluetooth, Radio Frequency (RF), Infrared, or optical coupling.

As shown in FIG. 1, the input device 102 may communicate with a computer 104, a laptop 106, a mobile device 108, a synthesizer 110, and a video game console 112. Mobile device 108 may be for example, a mobile phone, a smart phone, a Personal desktop Assistant (PDA) and so forth. Furthermore, the input device 102 may be connected to a server 116 through a network 114 and computer 104. Examples of network 410 include, but are not limited to, a Local Area Network (LAN), Wide Area Network (WAN), Wireless network (Wifi), a mobile network, the Internet and so forth. Only a limited type of external devices are illustrated, however a person skilled in the art will appreciate that other type of devices that use standard means of communication can also be connected to the input device 102. The input device 102 may be used to control the external devices, for example, transmit musical note information or play a video game executing on an external device. The input device 102 generates digital signals based on inputs provided by the user. The digital signals may be transmitted to the external devices. Moreover, the input device 102 can receive information from the external devices. For example, The input device 102 can be controlled or configured through external devices. Therefore, The input device 102 can function as a bi-directional device.

Figure 2:
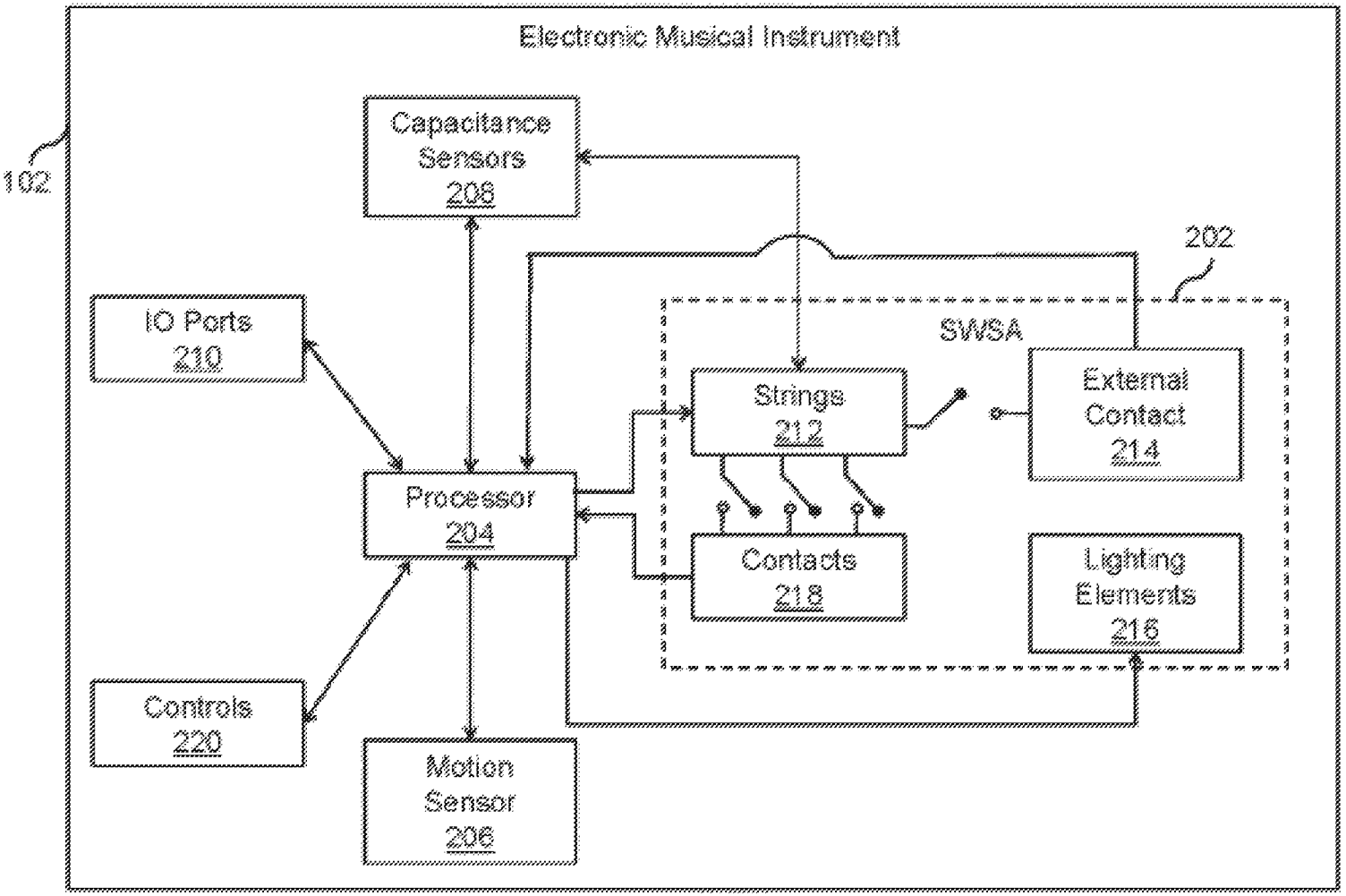
FIG. 2 illustrates an exemplary architecture of an electronic musical instrument, in accordance with some embodiments of the present technology.

With reference to FIG. 2 an exemplary architecture of the input device 102 is illustrated. The input device 102 may include a base. For example, in case the input device 102 has a shape of a musical instrument such as a guitar, than base may include a neck and a body. The input device 102 includes a Suspended Wire Switch Array (SWSA) 202 that may be used by the user to provide inputs to the input device 102. SWSA 202 includes contacts 218, strings 212, external contacts 214, and lighting elements 216. Contacts 218 are disposed on the body of the input device 102, and strings 212 are suspended over contacts 218. For example, in case the input device 102 has a shape of guitar containing a neck and a body, then contacts 218 may be arranged over the neck and strings 212 may be suspended over contacts 218. A typical arrangement of various components of the input device 102 is illustrated with reference to FIG. 3. The input device 102 may be connected to a power source to allow for operation of the input device 102. The power source may include an external or internal power source, or onboard power system such as batteries, or other power generation means. In an embodiment of the invention, the input device 102 may be powered from a USB connection.

The user may press one or more strings 212 to touch one or more contacts 218 for providing inputs. Strings 212 may be polled for inputs provided by the user. For example, the polling may be performed by sequentially or periodically transmitting signals through strings 212, while contacts 218 act as sink for the signals. Therefore, when the user presses a string to touch a contact, then a voltage is induced and SWSA 202 generates digital inputs signals. Sensing finger position and generating input signals is explained in greater detail below.

The input device 102 can detect mechanical inputs on the strings using capacitance sensors, piezoelectronic sensors, etc. and can process the inputs using signal processing circuitry, digital software processing techniques, and combinations thereof. Furthermore, the user may touch external contact 214 to one or more strings 212 to provide inputs. External contact 214 may be for example, a metal pick in case of a guitar. External contact 214 may be connected through wire or wirelessly to the input device 102. The detailed functioning and architecture of SWSA is also explained in a U.S. patent application Ser. No. 12/634,377, filed on Dec. 9, 2009 by the inventor of this invention, and is incorporated herein in its entirety by reference. Furthermore, lighting elements 216 may be provided on the body or neck of the input device 102. Lighting elements 216 may include for example, light emitting diodes, that light up to provide a visual feedback about the mode of The input device 102 to the user. The mode may include a musical instrument mode, a game controller mode, a standby mode and so forth. Moreover, the external devices connected to the input device 102 may control lighting elements 216. A processor 204 receives the digital input signals generated by SWSA 202.

Processor 204 is disposed on the neck of the input device 102. In an embodiment of the invention, processor 204 may be disposed on the body of the input device 102. Processor 204 may be connected to capacitance sensors 208 and motion sensor 206. Capacitance sensors 208 may also be connected to strings 212 to sense touching of the strings by the user. Therefore, when the user touches any string a digital signal is transmitted to processor 204 by capacitance sensors 208. The detection of touch may be used for advanced guitar playing techniques such as guitar muting. In some embodiments the input device 102 involves an array of piezoelectronic sensors configured to sense string vibration and a signal processing sub-system (explained in greater detail below) configured to translate mechanical string inputs and contact array inputs into digital signals.

Motion sensor 206 enables detection of orientation of the input device 102. Motion sensor 206 may be for example, a three axes and low gravity accelerometer. Motion sensor 206 transmits digital signals to processor 204 based on the orientation of the input device 102. Therefore, the user can provide inputs to the input device 102 by moving or rotating it. Processor 204 processes the signals received from strings 212, capacitance sensors 208 and motion sensor 206 to generate digital output signals. The digital output signals may correspond to musical note information. For example, the output digital signal may be MIDI signals based on the strings and notes selected by the user, and/or the orientation of the input device 102. The input signals are in a digital format; therefore output digital signals can be generated directly without any analog-to-digital or digital-to-analog conversion. As a result, the processing of the signals is faster, efficient, and without any delay or lag between the inputs provided by the user and output generated by the input device 102. Therefore, the user is provided with an experience of playing an instrument with an interface similar to that of a real instrument with efficient output. In an embodiment of the invention, the output signals may be analog signals.

Processor 204 may be connected to multiple Input/Output (IO) ports 210. The output signals generated by processor 204 are transmitted to the external devices through IO ports 210. Moreover, IO ports 210 may receive external signals from the external devices. Thereafter, processor 204 may process the external signals. The external signals may include signals to control or configure the input device 102. For example, processor 204 may receive signals from the external devices to control lighting elements 216. Therefore, The input device 102 functions as a bi-directional communication device. Examples of IO ports 210 include, but are not limited to USB, Firewire, RS232, RJ45, or other wired or wireless communication means such as RF or Bluetooth. IO ports 210 may be disposed on the body and processor 204 may be disposed on the neck of the input device 102. Further, the body may include controls 220 to control various features or modes of the input device 102. For example, the user may control the volume output, the mode of the input device 102, and other features from controls 220.

The body of the input device 102 may be detachable from the neck. Therefore, the body of the input device 102 can be customized based on the number and types of functionalities, and then connected to the neck. Further, processor 204 may automatically detect the number and types of IO ports 210 available in the body. For example, the user may not require a Firewire port, but requires an additional USB port, therefore, only the body of the input device 102 may be customized to meet the user's requirement. As a result, the user may have many options available to personalize the input device 102. In an embodiment of the invention, the body of the input device 102 may include a display for displaying information to the user. For example, the display may present the volume, connection with the external devices, power status, and so forth. Examples of the display include, but are not limited to, a Liquid Crystal Display (LCD), Light Emitting Diode (LED) display and so forth. Therefore, the user can buy different bodies based on the configuration required and hot-swap or replace the existing body without any significant interruption to functioning of the input device 102. As a result, the input device 102 is extremely customizable.

In some embodiments of the present technology, dock can be integrated into the input device and the dock can mechanically and electronically couple with an external device, e.g. a smartphone. The input device 102 can translate inputs into digital audio signals and provide them to the external device. The external device can output the audio signals through a speaker and can display information about the digital audio signals on a display. Also, the external device can contain software for providing a user with information about the audio signals (e.g. note information) of for providing interface elements for interacting with a user (e.g. instrument learning instructions). Likewise, the input device can be configured to allow the external device to control aspects of its operation. For example, the external device can contain software for controlling the lighting elements 212. Interaction between an external device and the input device 102 are explained in greater detail below.

Figure 3:
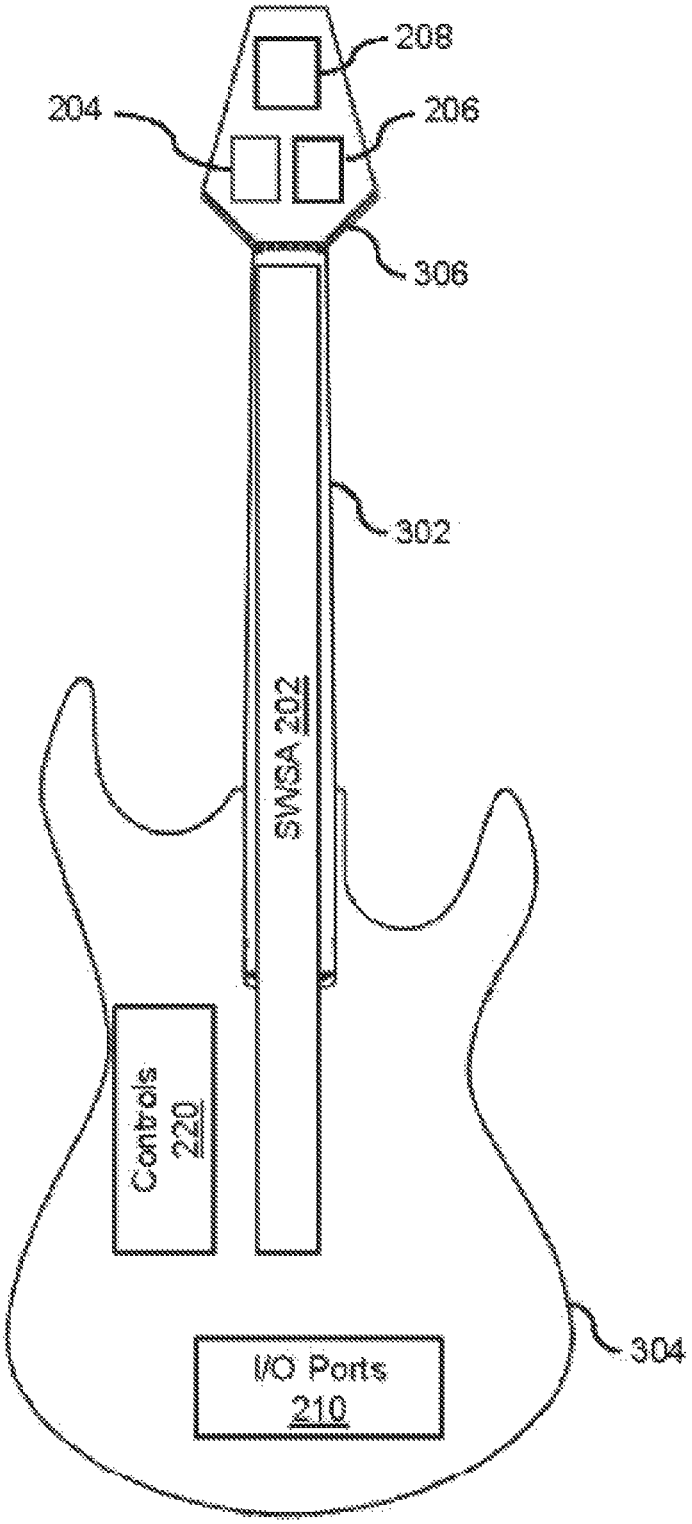
FIG. 3 illustrates an exemplary arrangement of various components of the electronic musical instrument, in accordance with some embodiments of the present technology.

FIG. 3 illustrates an exemplary arrangement of the various components of the input device 102. As discussed with reference to FIG. 2, the input device 102 may include a neck 302, a body 304 and a headstock 306. Neck 302 may be electrically connected to body 304. Moreover, neck 302 can be detached from body 304. For example, neck 302 and body 304 may be connected through a customized expansion port. The connected and disconnected neck and body of the input device 102 are explained with reference to FIG. 4*a-b*, and FIG. 5. In an embodiment of the invention, neck 302 and body 304 may be integrated and non-detachable. As shown in FIG. 3, SWSA 202 may be disposed on neck 302. Moreover, strings 212 of SWSA 202 may be disposed on neck 302 and terminated on a bridge (not shown) on body 304, as in case of a standard stringed instrument such as a guitar. Further, processor 204, capacitance sensors 208, and motion sensor 206 may be disposed on headstock 306. Body 304 may include IO ports 304 and controls 220. As discussed with reference to FIG. 2, the number and type of IO ports 304 can be customized based on the requirements of the user. Therefore, The input device 102 may present an interface that looks like a real stringed instrument to the user. A person skilled in the art will appreciate that the position of the various components maybe exemplary, and various other arrangements are possible.

In some embodiments of the present technology, the input device 102 includes a bridge for supporting the strings on the body and containing an input sensor array (e.g. piezoelectric sensor array). The input sensor array can also communicate with a signal processing subsystem, as explained in greater detail below.

Figure 4A:
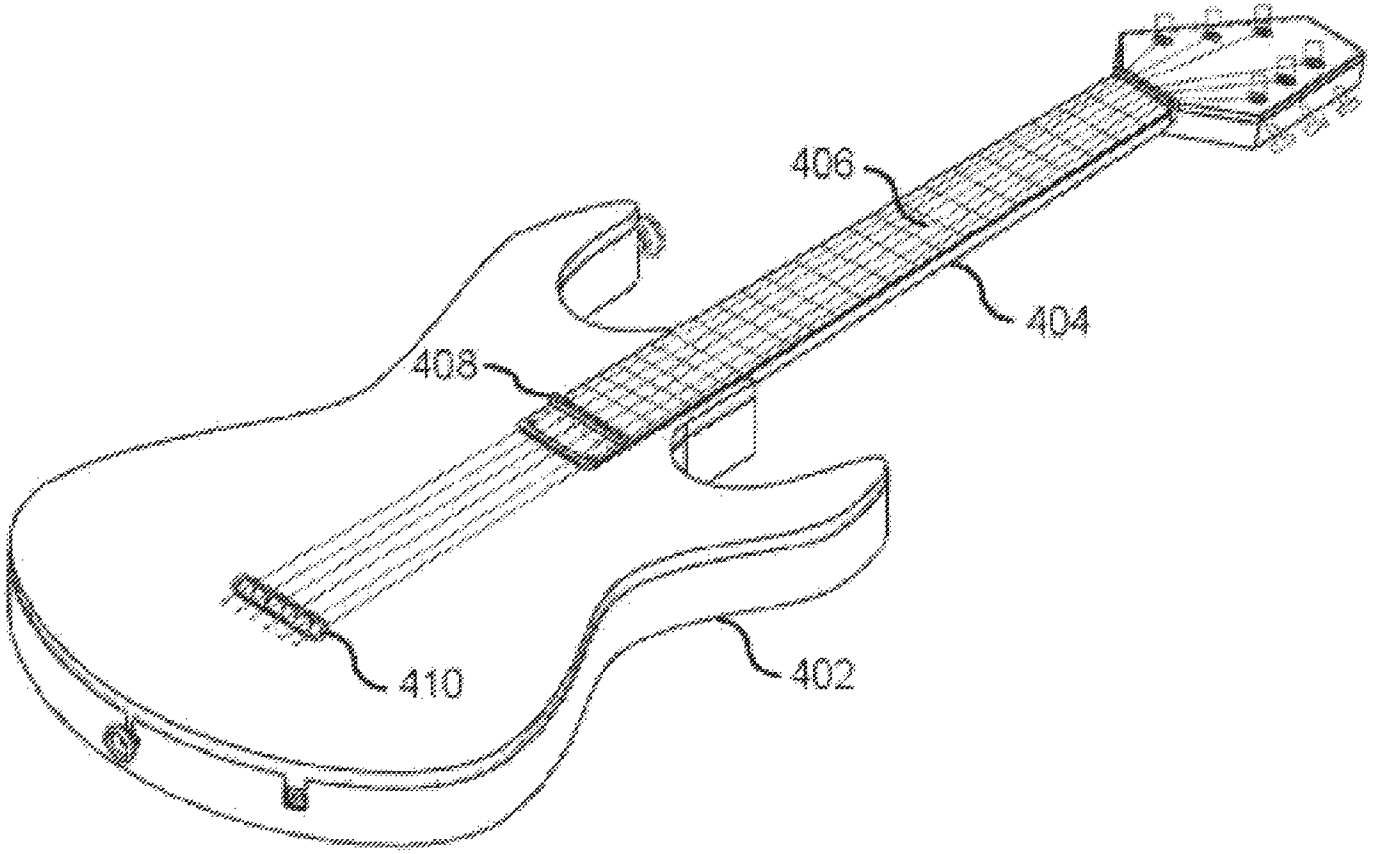
FIGS. 4A and 4B illustrate exemplary view with a neck and a body of electronic musical instrument connected, in accordance with some embodiments of the present technology.
Figure 4B:
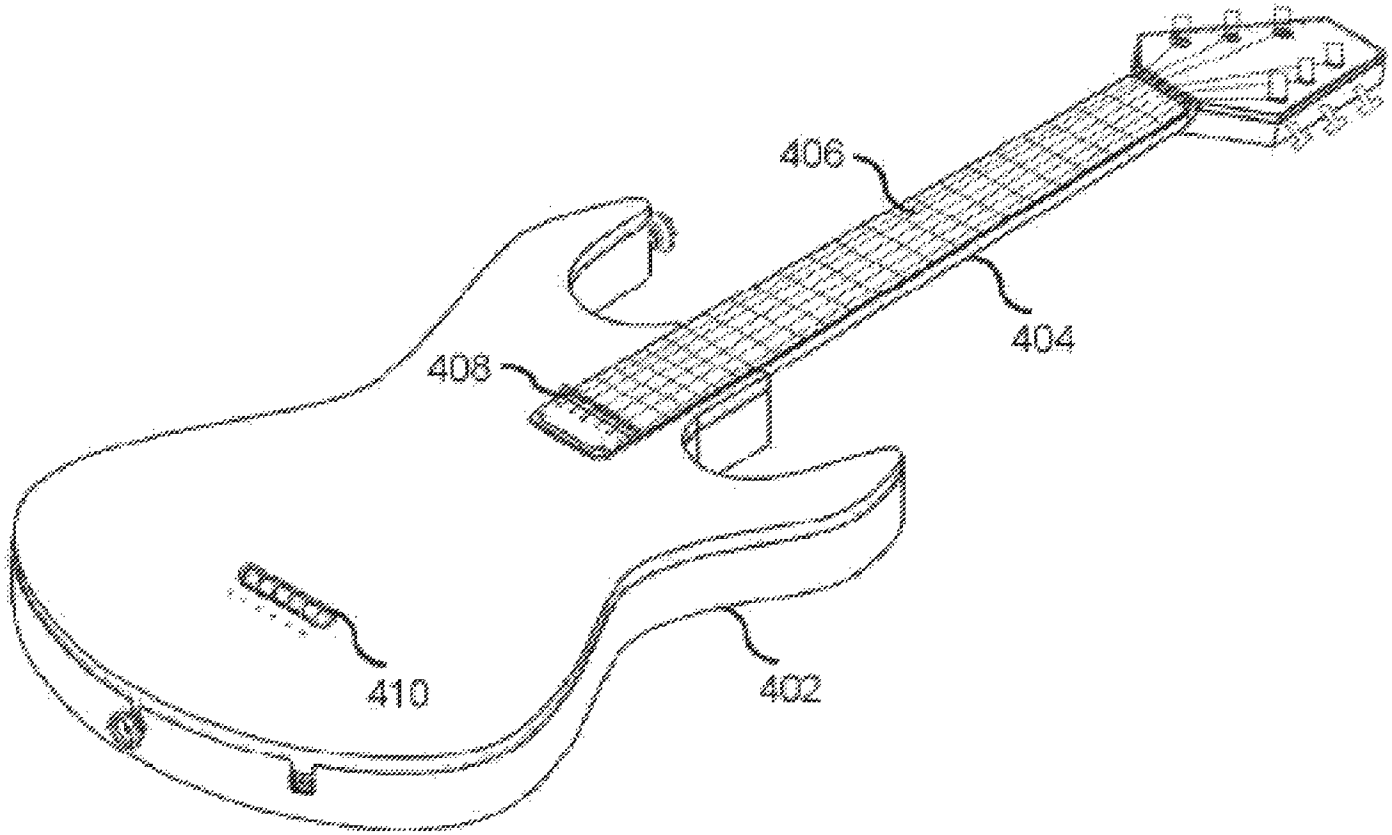

With reference to FIG. 4*a*, a neck 404 and a body 402 of the input device 102 are illustrated in a connected configuration. As shown, the input device 102 may include a neck bridge 408 and a body bridge 410 with corresponding holes for connecting strings 406. Neck bridge 408 is disposed on neck 404 and body bridge 410 is disposed on body 402 of The input device 102. Moreover, neck bridge 408 may be removable from neck 404. Therefore, The input device 102 can be customized based on the preferences of the user. For example, the user may remove neck bridge 408 and use body bridge 410.

Figure 5:
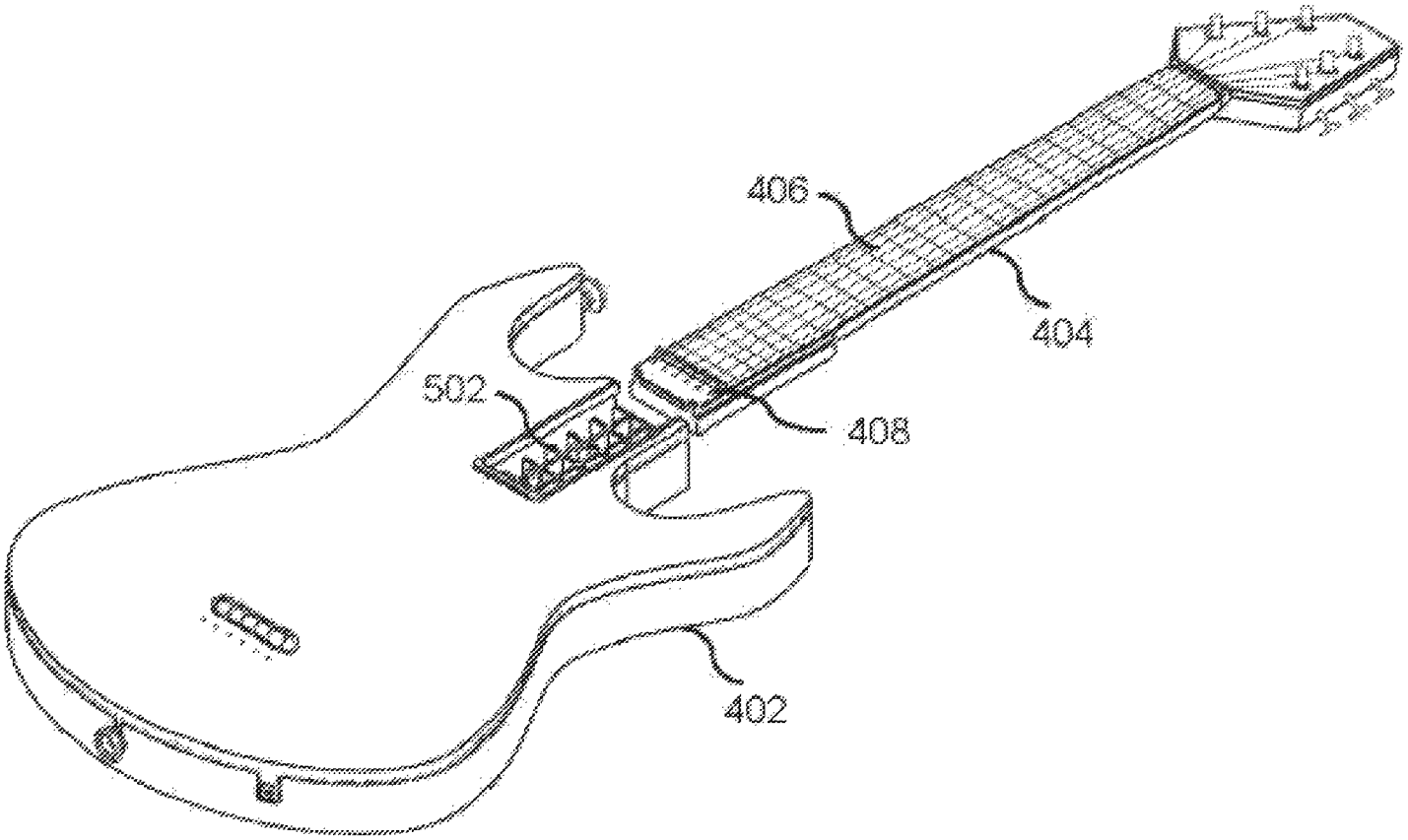
FIG. 5 illustrates exemplary view with the neck and the body of electronic musical instrument disconnected, in accordance with an embodiment of the present technology.

Therefore, as shown with reference to FIG. 4 *a*, strings 406 may be connected to body bridge 410. Alternatively, strings 406 may be connected to neck bridge 408 as shown with reference to FIG. 4 *b*. A person skilled in the art will appreciate that neck 404 may be designed to be longer than that of a conventional musical instrument such as guitar, for neck bridge 408 to look and function like body bridge 410. When strings 406 are connected to neck bridge 408, the swapping of body 402 with another body becomes easier, as the user may not be required to remove strings 406. The disconnected arrangement of neck 404 and body 406 is illustrated in FIG. 5. As shown, strings 406 are connected to neck bridge 408. Further, body 402 includes a connection mechanism 502, for connecting and disconnecting neck 404 and body 402. Connection mechanism 502 may include mechanism to electrically and mechanically connected neck 404 and body 402. For example, connection mechanism 502 may include a groove and spring mechanism for mechanical connectivity and an expansion port for electrical connectivity of neck 404 and body 402. Therefore, as also discussed above, bodies for The input device 102 can be hot-swapped easily.

Figure 6:
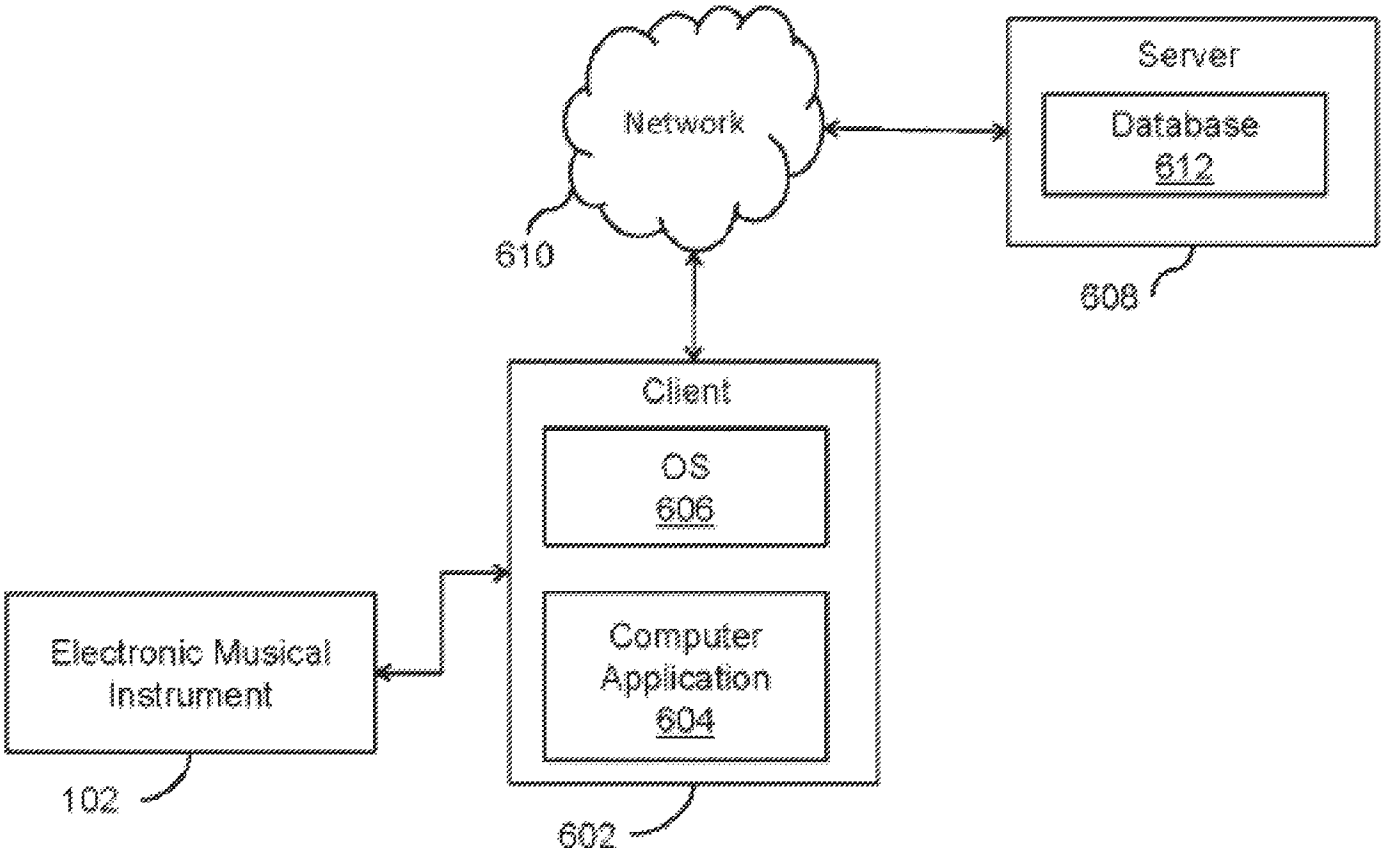
FIG. 6 is an exemplary connectivity architecture of the electronic musical instrument with external devices, in accordance with some embodiments of the present technology.

FIG. 6 illustrates an exemplary connectivity architecture of the input device 102 with the external devices is illustrated. As discussed with reference to FIG. 1, the external devices may include a computer, a laptop, a mobile phone, a video game console and so forth. Further the external devices may be connected to other external devices over a network such as the Internet. For example, various video game consoles such as Playstation enables the user to connect to the Internet. Therefore, the user can interface with other users in real-time over the network. Additionally, as explained above, some embodiments of the present technology involve the device coupling with the input device 102 through a dock integrated into the input device 102.

As shown in FIG. 6, the input device 102 may connect and communicate with an external device 602, here after referred to as client 602. Client 602 may include a computer application 604 that receives and/or sends the signals to the input device 102. Computer application 604 may be software or firmware on client 602. Moreover, client 602 may include an Operating System (OS) 606 for executing computer application 604. A person skilled in the art will appreciate that computer application 604 may be implemented directly on hardware of client 602; therefore OS 606 may not be required. Computer application 604 may process the output signals from The input device 102 to generate musical notes. Moreover, computer application 604 may process the output signals from the input device 102 to control other application such as a video game on client 602 or over the network.

Client 602 may be connected to a server 608 through a network 610 or cloud based services. Examples of network 610 include, but are not limited to, a Local Area Network (LAN), Wide Area Network (WAN), Wireless network (Wifi), a mobile network, the Internet and so forth. Server 608 may include computer applications and a database 612 to enable communication with various clients. Therefore, client 602 may connect to the application available on server 608, or connect to other clients through server 608. As a result, the user can interface or compete with other users in real-time. Furthermore, computer application 604 on client 602 may be used to control or configure the input device 102. For example, lighting elements of the input device 102, the mode of the input device 102 may be controlled from computer application 604. Moreover, computer application 604 can configure the programming of components of the input device 102, such as processor 204. For example, the firmware or software of processor 204 may be configured or upgraded from computer application 604 of client 602.

With the above components and design thereof in mind, it should be appreciated that alternative components, constructions and materials can be used to accomplish the benefits derived from the input device 102. For example, the input device 102 may comprise more than one processor.

Having discussed the exemplary embodiments and contemplated modifications, it should be appreciated that a method for processing inputs provided by a user on an electronic musical instrument is also contemplated. According to this method, an electronic musical instrument is provided. The electronic musical instrument, here after referred to as The instrument, may include a Suspended Wire Switch Array (SWSA), a processor, multiple Input/Output (IO) ports, one or more capacitance sensors and a motion sensor.

The user touches strings to press contacts of the SWSA to generate digital input signals. Moreover, digital input signals are generated based on sensing of touch by the capacitance sensors. Furthermore, digital input signals are generated based on sensing of orientation of the instrument by the motion sensor. The digital input signals are received by the processor that processes the input signals to generate digital output signals. The output digital signals correspond to musical note information. For example, the musical note information may include MIDI signals.

Further, the output signals can be transmitted through the IO ports to external devices, a device inserted into an integral dock, etc. Thereafter, the external devices generate musical notes based on the output signals. The external devices may also transmit digital signals for controlling or configuring the instrument. The user is provided a visual feedback based on the function or mode of the instrument, through lighting elements connected to the processor. Additionally, the user may control various features such as the volume, or mode of the instrument from controls on the instrument. Moreover, the body of the instrument can be detached from the neck.

Figure 7A:
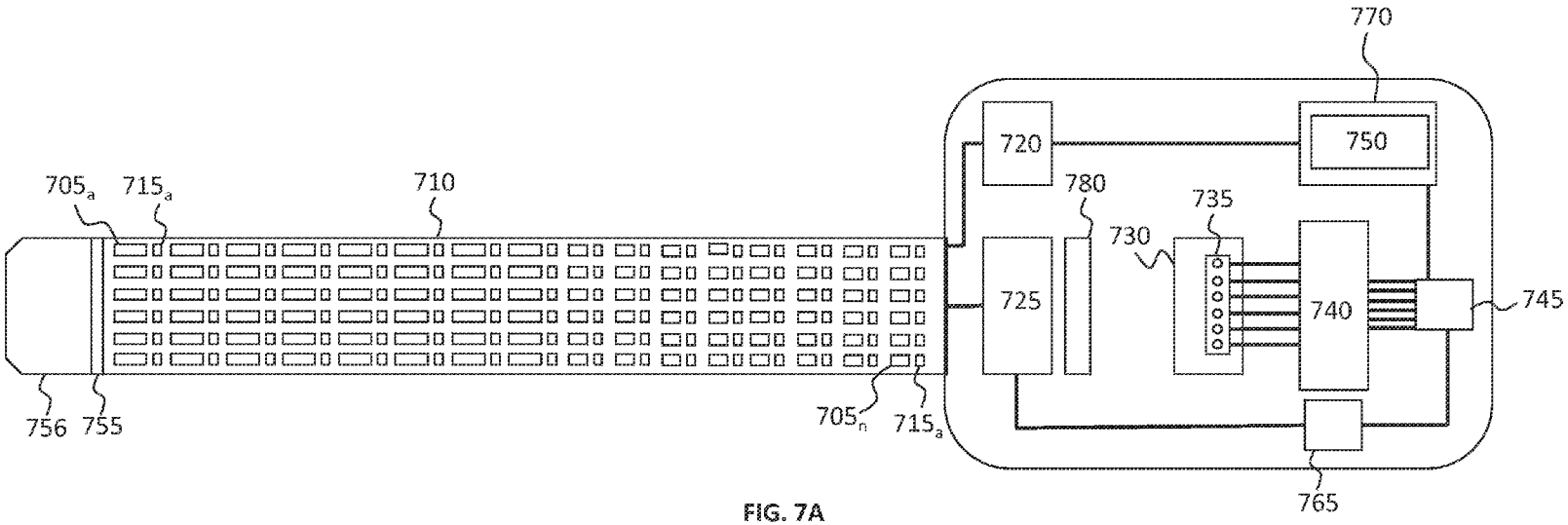
FIG. 7A and FIG. 7B illustrate an exemplary input device according to some embodiments of the present technology.
Figure 7B:
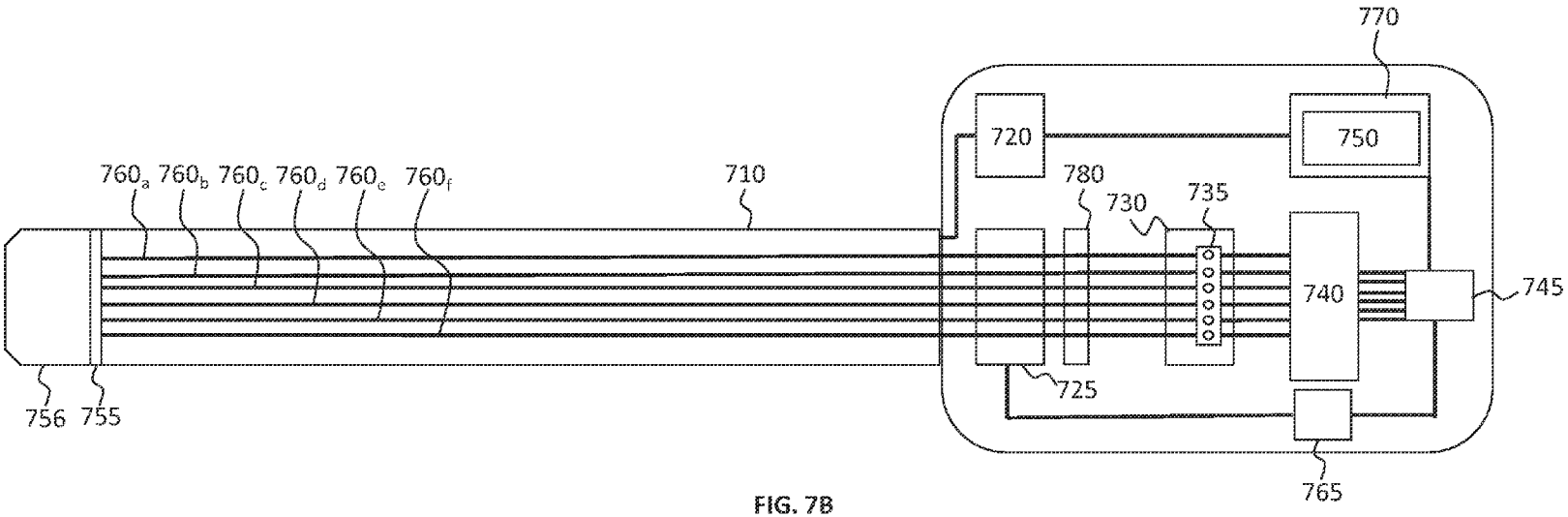

FIG. 7A and FIG. 7B illustrate an exemplary input device 700 according to some embodiments of the present technology. The input device 700 includes a switch array base 710 and a body 770 housing a number of other components. The switch array base 710 includes an array of conductive contacts $\mathbf{715}_{a\text{-}n}$ electronically coupled with a switch monitoring system 725 in the body 770. The switch array base 710 can be in the form of a guitar neck with the array of conductive contacts $\mathbf{715}_{a\text{-}n}$ taking the form of guitar frets that are physically disjointed to maintain electrical isolation of the conductive contacts $\mathbf{715}_{a\text{-}n}$.

The switch array base 710 also includes an array of apertures $\mathbf{705}_{a\text{-}n}$, disposed in the surface of the base. The apertures $\mathbf{705}_{a\text{-}n}$ can comprise light tunnels for allowing light produced from a light source (not shown) beneath the surface of the base to pass through. In some cases, the apertures $\mathbf{705}_{a\text{-}n}$ can comprise a cavity filled with a transparent, translucent, semi-opaque, etc. material using a double-injection molding technique, explained below. Also, in some embodiments, the light source can comprise one or more LED isolated beneath each aperture 705. Also, the light source(s) can be electronically coupled with a lighting processor 720 in the base 770. For example, the light source(s) can comprise a multi-color (e.g. RGB) LED and the lighting processor 720 can be configured to selectively mix the colors. Also, as is explained in greater detail below, the light source(s) can comprise an infrared (IR), object sensing LED electronically coupled with the lighting processor 720 and the switch monitoring system 725.

For the purpose of clarity, FIG. 7A illustrates the input device 700 without conductive wires $\mathbf{760}_{a\text{-}f}$ strung over the switch array base 710. Similarly, FIG. 7B illustrates the input device 700 having conductive wires $\mathbf{760}_{a\text{-}f}$ strung over the switch array 710, but without the array of conductive contacts $\mathbf{715}_{a\text{-}n}$ or the array of apertures $\mathbf{705}_{a\text{-}n}$ disposed therein.

As is explained in greater detail below, the array of conductive contacts $\mathbf{715}_{a\text{-}n}$ and the conductive wires $\mathbf{760}_{a\text{-}f}$ are configured for detecting inputs in the form of a conductive wire 760 making contact with one or more conductive contact 715. Therefore, the conductive wires $\mathbf{760}_{a\text{-}f}$ are provided with a voltage. For example the input device 700 can include a power source 765 electrically coupled with the conductive wires $\mathbf{760}_{a\text{-}f}$ in one ore more ways including via a bridge 730, where the conductive wires $\mathbf{760}_{a\text{-}f}$ terminate, etc.

As explained in greater detail below, the array of conductive wires $\mathbf{760}_{a\text{-}f}$ can be strung between two insolating blocks. For example, in some embodiments of the present technology, the conductive wires $\mathbf{760}_{a\text{-}f}$ are strung between an insulated bridge 730 and a nut 755 located on a headstock 756.

The array of conductive contacts $\mathbf{715}_{a\text{-}n}$ can be electronically coupled to a switch monitoring system 725 (explain in greater detail below). The contacts $\mathbf{715}_{a\text{-}n}$ can be electronically coupled to a switch monitoring system 725 in a variety of ways. For example, each column (i.e. a group of contacts forming a disjointed guitar fret) of contacts 715 can be coupled to a unique port (not shown) to the switch monitoring system 725. Accordingly, an array of sixteen columns of contacts would involve sixteen separate inputs to the switch monitoring system 725.

When a conductive wire 760 makes contact with a conductive contact 715, a current is generated and a signal is sent to the switch monitoring system 725. As is explained in greater detail below, the switch monitoring system 725 can process the signal (e.g. to generate musical note information) and transmit the processed signal to a processor 745.

The input device 700 is also configured to detect when a conductive wire 760 is displaced, vibrates, etc. Accordingly, the conductive wires $\mathbf{760}_{a\text{-}f}$ can be thread through a bridge 730 containing a piezoelectric sensor array 735. The piezoelectric sensor array 735 contains an isolated piezoelectric sensor (not labeled) for each wire 760. Additionally, each piezoelectric sensor is electronically coupled with signal processing sub-system 740. The signal processing sub-system 740 processes, as explained in greater detail below, and transmits a processed signal to the processor 745. The input device 700 can also include a mute 780 that reduces attenuation in the conductive wires $\mathbf{760}_{a\text{-}f}$. In some embodiments of the present technology, the mute 780 is made of an insulating material. Also, the mute 780 does not impede the movement of the conductive wires $\mathbf{760}_{a\text{-}f}$ up and down, with respect to the surface of the input device 700, but only applies muting/attenuation in the wave propagation direction.

The input device 700 can also include a dock 785 and circuitry (not shown) for housing an external device 750 and for coupling the external device 750 with system components such as the processor 745, the lighting processor, etc. The external device 750 can receive information from the input device 700 (e.g. MIDI data) and can also provide data to the input device (e.g. to drive the light sources). Similarly, the external device 750 can download updates from an external server and provide updates to the input device, as explained in greater detail below.

Figure 8A:
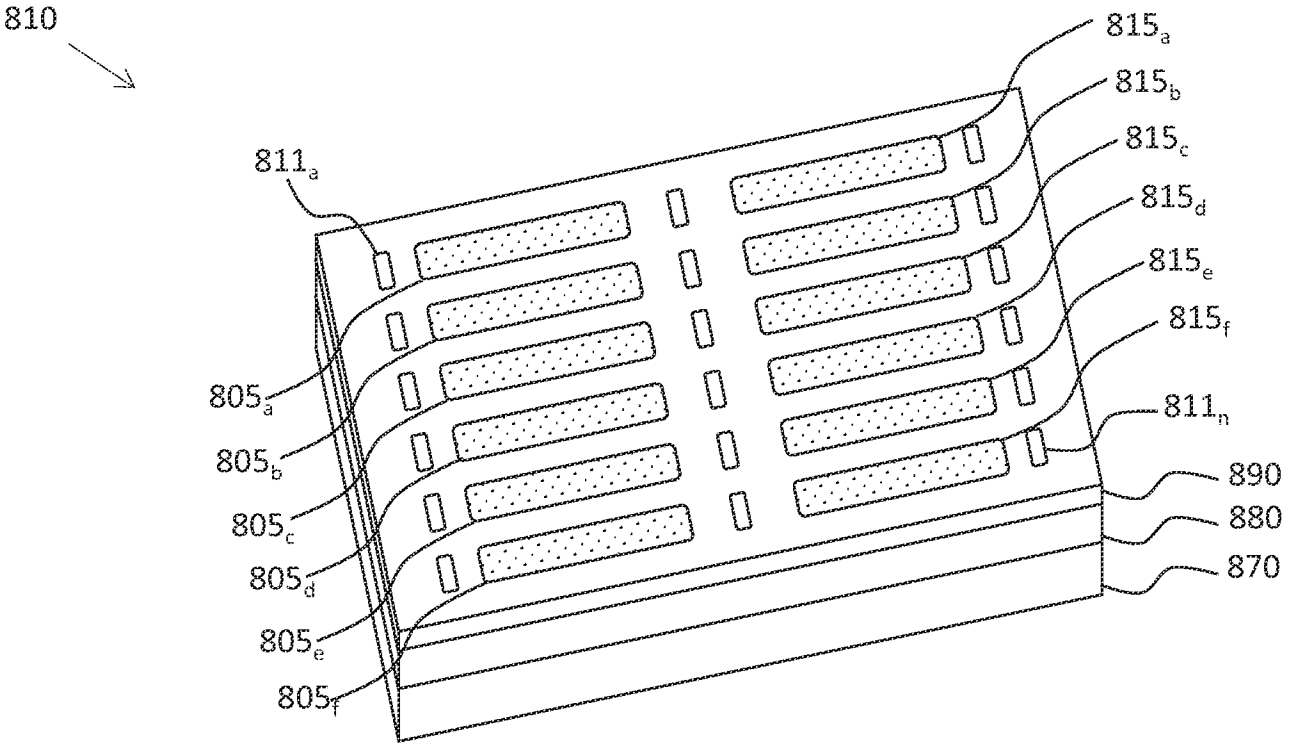
FIGS. 8A-8C illustrate views of an exemplary switch array base with a double-injected top surface according to some embodiments of the present technology.
Figure 8B:
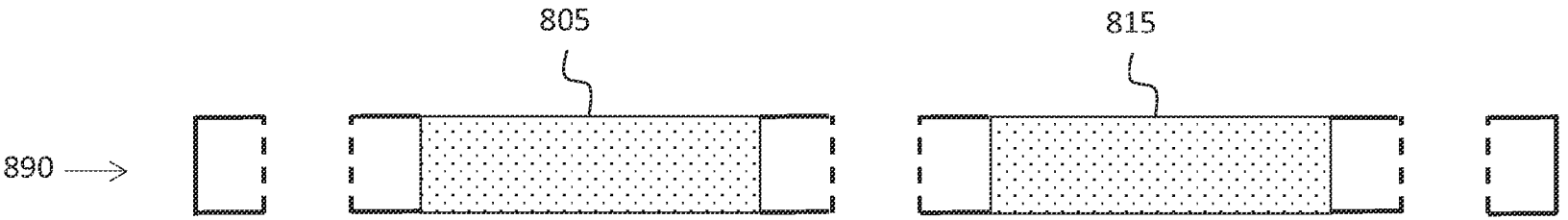
Figure 8C:
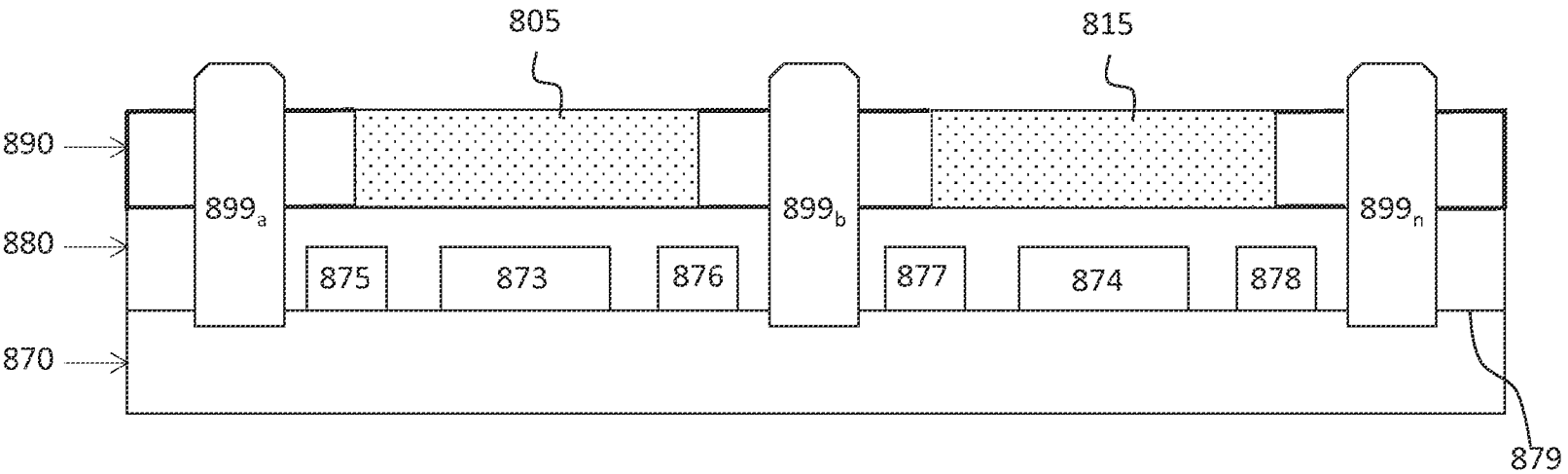

As explained above, the switch array base 710 can include an array of apertures $\mathbf{705}_{a\text{-}n}$ filled with a transparent, translucent, semi-opaque, etc. material using a double-injection molding technique. FIGS. 8A-8C illustrate views of an exemplary switch array base 810 with a double-injected top surface 890 according to some embodiments of the present technology.

FIG. 8A illustrates an isometric view of a portion of the switch array base 810 with a multi-layer construction including a top surface 890 having apertures $\mathbf{805}_{a\text{-}f}$, $\mathbf{815}_{a\text{-}f}$ and through holes $\mathbf{811}_{a\text{-}n}$. The switch array base 810 can also include a PCB and component layer 880 and a structural base layer 870.

The top surface 890 can comprise a first surface material molded during a first injection step that leaves the apertures $\mathbf{805}_{a\text{-}f}$, $\mathbf{815}_{a\text{-}f}$ as empty cavities. The apertures $\mathbf{805}_{a\text{-}f}$, $\mathbf{815}_{a\text{-}f}$ can comprise a second material molded into the cavities during a second injection step. FIG. 8B illustrates a side view of the top surface 890 showing the apertures 805, 815 and through holes 811.

The switch array base 810 can also include a PCB and component layer 880 and a structural base layer 870. FIG. 8C illustrates a side view of the switch array base 810 including a top surface 890, a PCB and component layer 880 and a structural base layer 870. The PCB and component layer 880 can include a printed circuit board (PCB) 879 and a plurality of surface-mounted electronic components. For example, the PCB and component layer 880 can include contact detection circuitry 878, 877, 876, 875 as well as LED components 874, 873. In some cases the LED components 874, 873 can comprise surface-mounted RGB LEDs, object-detecting IR LEDs, or both surface-mounted RGB LEDs and object-detecting IR LEDs. As shown in FIG. 8C, the through hole 811 are filled with contacts $\mathbf{899}_{a,b,\ldots n}$ that are electrically coupled with the PCB and/or one or more of the surface-mounted electronic components and configured to detect contact with an electrically charged wire.

In some embodiments of the present technology, the LED components 873 and 874 are positioned under apertures 805*a* and 815*a*, respectively and the second material that is injected into the apertures 805 and 815 is selected for its light diffusion quality. Consequently, the light emitted by the LED components 873 and 874 appears more evenly distributed in the apertures 805, 815.

Detecting Inputs

Figure 9:
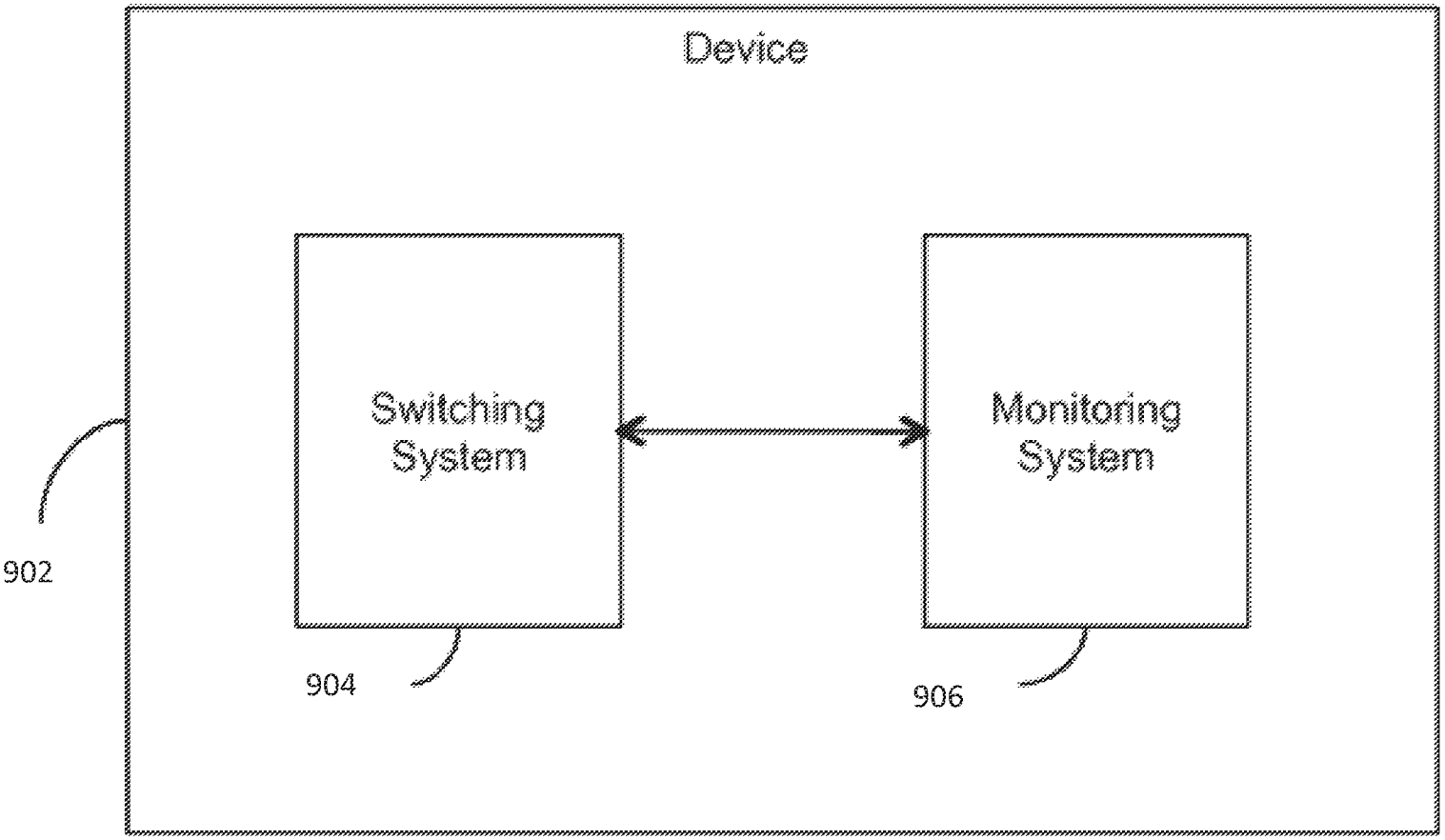
FIG. 9 is an exemplary block diagram of a device for registering inputs from a user, in accordance with some embodiments of the present technology.

With reference to FIG. 9, an exemplary block diagram of a device 902 for registering inputs from a user is illustrated. Device 902 may be an electronic device that takes inputs from the user and generates corresponding output. Examples, of device 902 include, but are not limited to, a keyboard, a keypad, an input interface for an electronic or digital instrument and so forth. Device 902 can provide a feedback to the user based on the input or the output. Examples of feedback include, but are not limited to, a mechanical feedback, a visual feedback, an audio feedback and so forth. Furthermore, device 902 can be connected to other electrical or electronic devices to provide output or feedback to the user. For example, the other electronic devices can be a smartphone, acomputer, a laptop and the like. Moreover, device 902 may be connected to other devices through wired or wireless means. Device 902 includes a switching system 904 and a monitoring system 906 to take inputs and/or provide output to the user.

Switching system 904 includes multiple conductive wires suspended over an array of conductive pads. For example, an array of conductive pads can be an array of conductive contacts electronically coupled with a printed circuit board that includes circuitry for detecting and registering mechanical behavior of the conductive wires. The user may provide an input by pressing the wires on to the conductive pads. Therefore, switching system 904 may function as an array of electronic switches. However, unlike the electronic switches generally known in the art, switching system 904 does not require an element to connect metal contacts for opening or closing the flow of current. The inputs provided by the user are monitored and analyzed by monitoring system 906 to generate an output. Furthermore, switching system 904 provide the user micro timing control of the inputs. The components and functioning of switching system 904 are explained in detail in conjunction with FIGS. 10, 11 and 12.

Figure 10A:
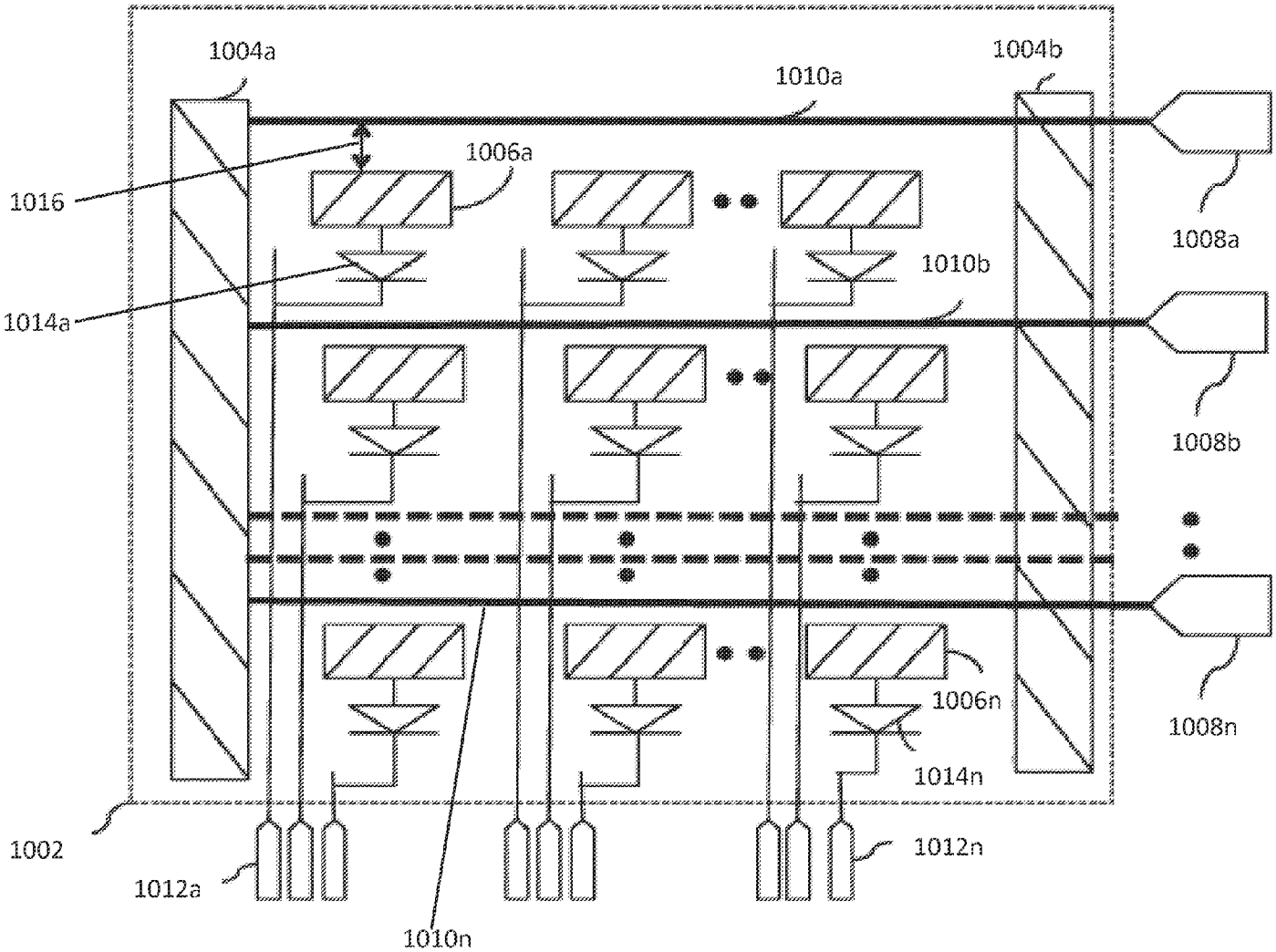
FIG. 10A illustrates various components of an exemplary switching system having individual second ports, in accordance with some embodiments of the present technology.

With reference to FIG. 10A various components switching system 904 may include a base surface 1002, insulating blocks 1004*a-b*, an array of conductive pads 1006*a-n*, first ports 1008*a-n*, conductive wires 1010*a-n*, second ports 1012*a-n*, and current restricting components 1014*a-n*. Base surface 1002 may be an insulating material. Base surface 1002 ensures that no short circuit occurs between any points of the contacts mounted on it. Further, the insulating material of base surface 1002 may be flexible. Array of conductive pads 1006 *a-n* may be disposed on base surface 1002 in form of multiple rows and columns as illustrated with reference to FIG. 10A. In an embodiment, array of conductive pads 1006*a-n* may be generated by printing a conductive material on an integrated circuit material. Examples of the conductive material include, but are not limited to, copper, gold, aluminum, silver and so forth. Each conductive pads 1006*a-n* may be connected individually to second ports 1012*a-n*. Further, conductive pads 1006*a-n* may be maintained at a first electric potential. In an embodiment of the invention, the first electric potential may be a ground potential.

Conductive wires 1010*a-n* are suspended over conductive pads 1006*a-n* at a physical distance 1016. Physical distance 1016 may selected during design of device 902 based on the application of device 1002. For example, physical distance 216 may be more in applications that require micro timing control of inputs. As shown in FIG. 10A, conductive wires 1010*a-n* are suspended over the rows of conductive pads 1006*a-n*. It will be apparent to a person skilled in the art that conductive wires 1010*a-n* can be suspended over the columns of conductive pads 1006*a-n*. Conductive wires 1010*a-n* may be designed from any conductive material, length or thickness based on the application of device 902. For example, in some embodiments of the present technology the conductive wires replicate the varied thickness of strings on a stringed instrument. Conductive wires 1010*a-n* are suspended from insulating blocks 1004*a-b* to first port 1008. Insulating blocks 1004*a-b* may be disposed on base surface 1002 and provide tension to conductive wires 1010*a-n*. The tension in conductive wires 1010*a-n* provides a spring or elastic force. As a result, when the user removes the force, conductive wires 1010*a-n* automatically regain a default position. Therefore, additional components to provide a spring force are not required in device 902.

Furthermore, insulating blocks 1004*a-b* provide insulation among conductive wires 1010*a-n*, thereby preventing any short circuit. As shown, insulating blocks 1004*a-b* are arranged at the ends of the array of conductive pads 1006*a-n*. In an embodiment of the invention, multiple insulating blocks 1004*a-b* may be arranged between columns or rows formed by the array of conductive pads 1006*a-n*. Insulating blocks 1004*a-b* may be non-terminating. Therefore, a conductive wire suspended from the insulating blocks 1004*a-b* is able to transmit current or signal without any restriction. However, insulating blocks 1004*a-b* may restrict the flow of current among conductive wires 1010*a-n*. In another embodiment of the invention, only a single insulating block 1004 may be used to suspend conductive wires 1010*a-n* from first ports 1008*a-n*.

In some embodiments of the present technology, the insulating blocks 1004*a-b* may be components of an instrument such as a guitar bridge and headstock, respectively.

First ports 1008*a-n* provides a second electric potential to conductive wires 1010*a-n*. The second electric potential may be at an absolute relative difference from the first electric potential provided to conductive pads 1006*a-n*. In an embodiment of the invention, the second electric potential is more than the first electric potential. Therefore, when the user contacts a conductive wire with a conductive pad, a current flows in switching system 904. Hence, each conductive pad 1006*a-n* may act as an independent electrical switch and array of conductive pad 1006*a-n* may acts as an array of electrical switches to take inputs from the user. Each electrical switch may considered in an 'off' state when the current is not flowing and an 'on' state when the current is flowing through the switch. Conductive pads 1006*a-n* are connected to current restricting elements 1014*a-n* at ends. Generally, electrical switches with array design encounter the issue of ghosting or masking Typically, the ghosting or masking refers to the phenomena that occur when current flows in a wrong or unintended direction. This means that if two switches are closed on different columns but on adjacent rows, then current will flow in the wrong or unintended direction. As a result, a non-existent key press is detected. Current restricting elements 1014 *a-n* connected to conductive pads 1006*a-n*, allow current to flow in only one direction. For example, the current may flow only from first port 1008 to second ports 1012*a-n*. Therefore, the issues of ghosting or masking may be prevented. Current restricting elements 1014*a-n* may be semiconductor elements such as diodes.

Figure 10B:
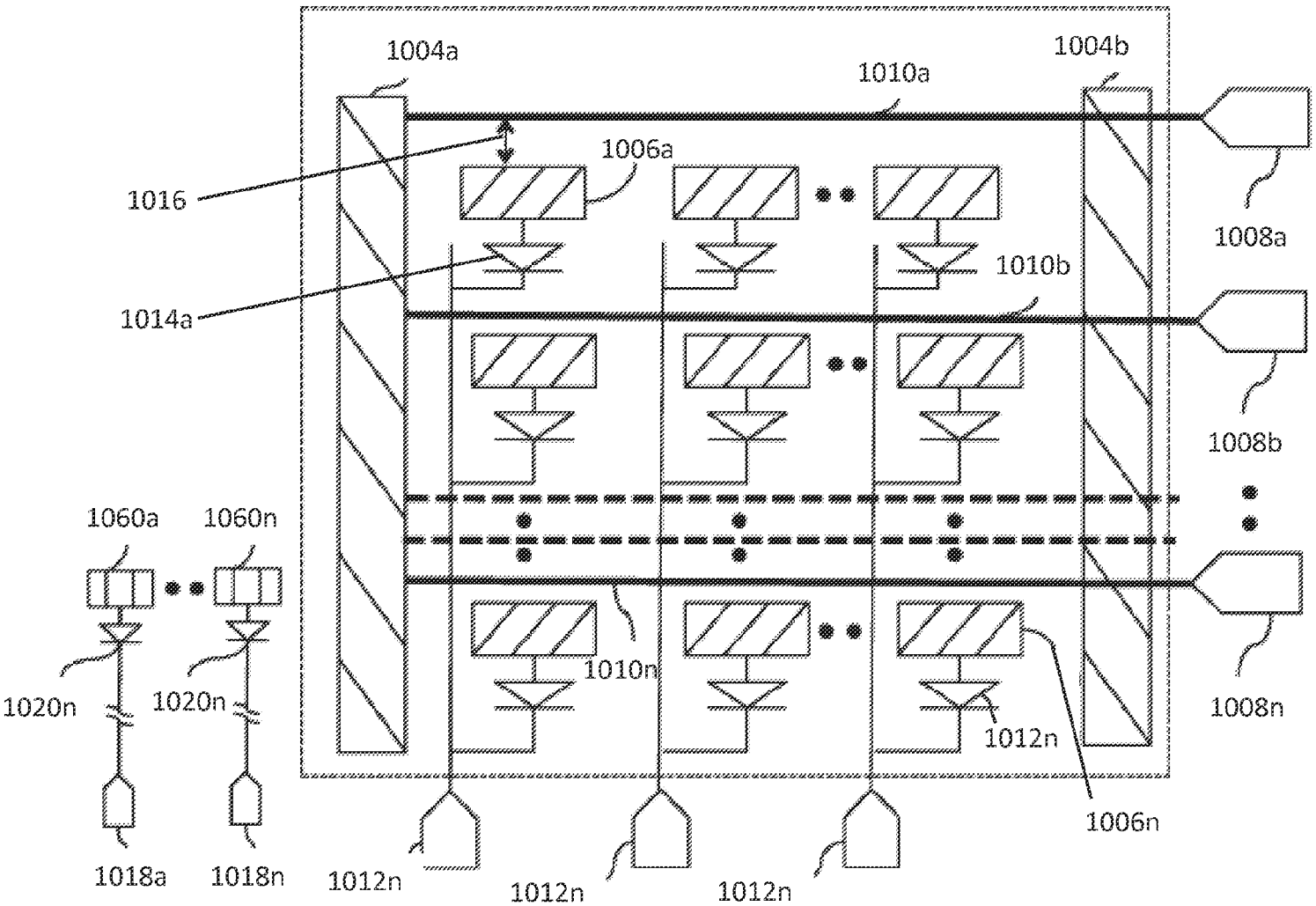
FIG. 10B illustrates various components of an exemplary switching system having shared second ports and conductive pins, in accordance with some embodiments of the present technology.

Conductive pads 1006*a-n* may share second ports 1012*a-n*, as shown with reference to FIG. 10B. Therefore, the components required for switching system 904 may be further reduced. As shown with reference to FIG. 10B, switching system 904 may include conductive pins 1060*a-n*. Conductive pins 1060*a-n* may be connected to third ports 1018*a-n*. Conductive pins 1060*a-n* may be a movable and can contact any conductive wires 1010*a-n*. The user may contact conductive pins 1060*a-n* to conductive wires 1010*a-n* to provide inputs. In an embodiment of the invention, the function of conductive pins 1060*a-n* may be similar to that of conductive pad 1006*a-n*. Further, conductive pins 1060*a-n* may be connected to a current restricting elements 1020*a-n* as shown. In another embodiment of the invention, conductive pins 1060*a-n* may provide the second potential to conductive wires 1010*a-n*. Conductive pins 1060*a-n* are provided with a third electric potential. In an embodiment of the invention, the third electric potential may be equal to the first electric potential provided to conductive pads 1006*a-n*. In another embodiment of the invention, the third potential may be equal to the second potential provided to conductive wires 1010*a-n*.

Figure 11:
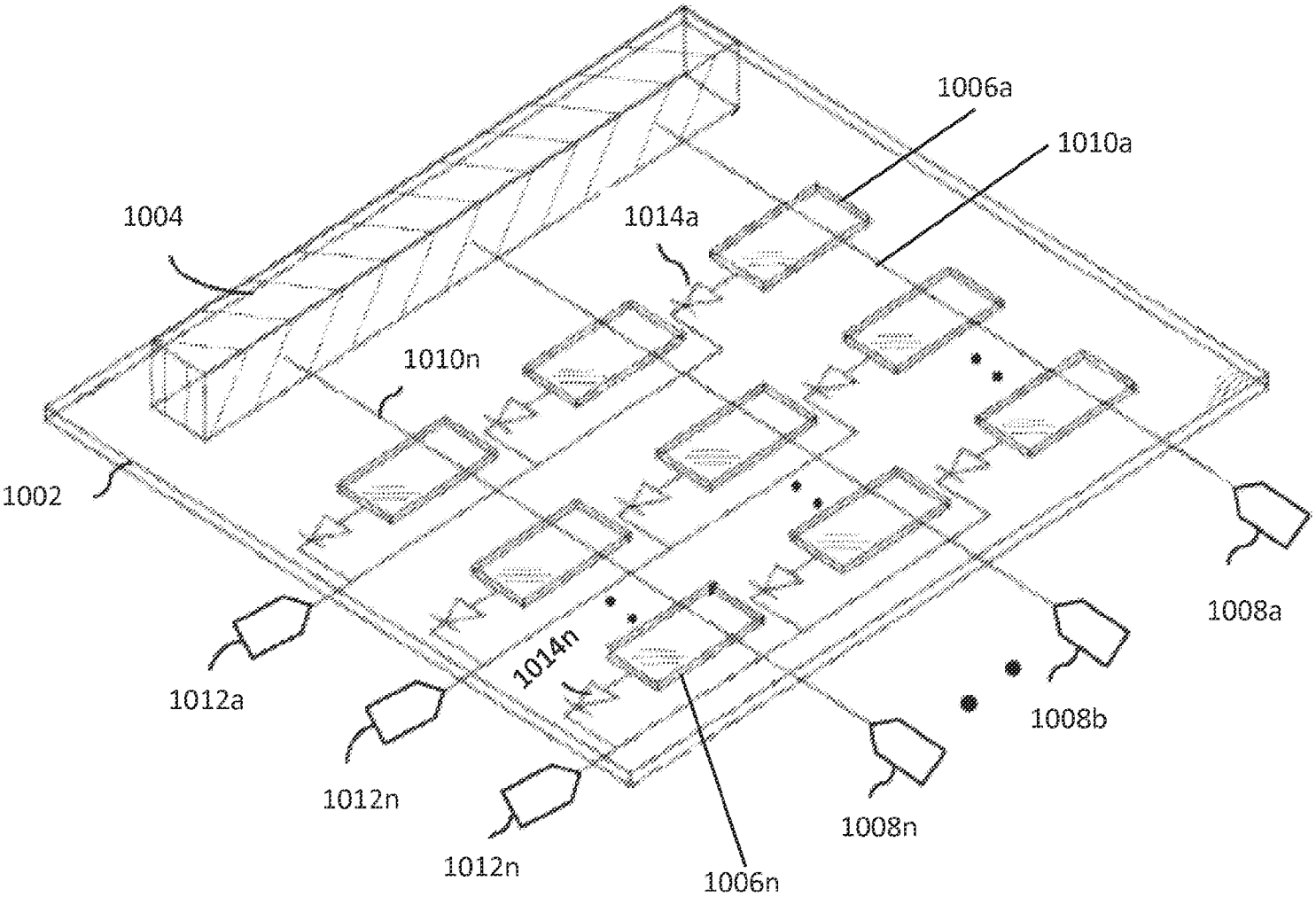
FIG. 11 is a perspective view of the switching system, in accordance with some embodiments of the present technology.
Figure 12A:
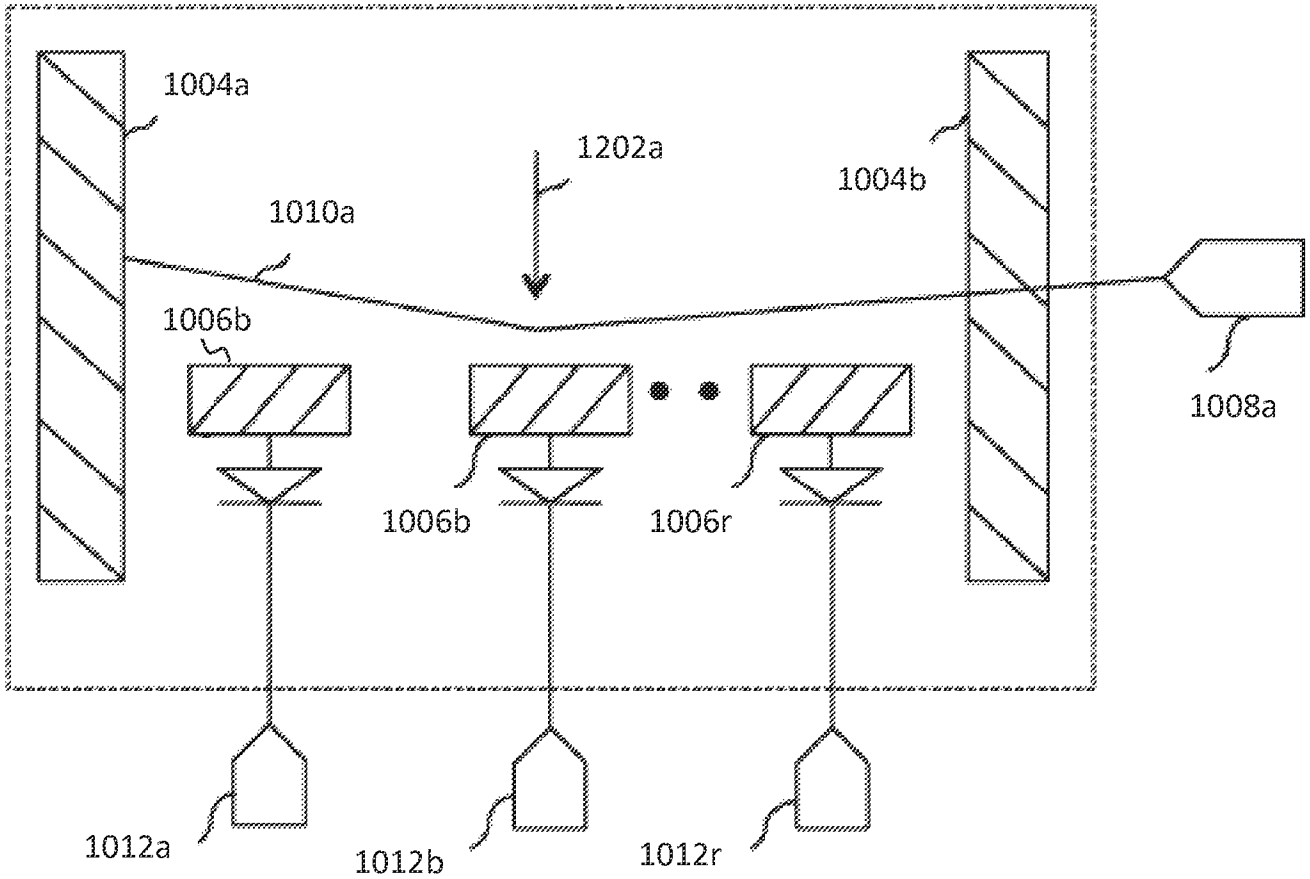
FIG. 12A illustrates an exemplary actuation of the switching system, in accordance with some embodiments of the present technology.
Figure 12B:
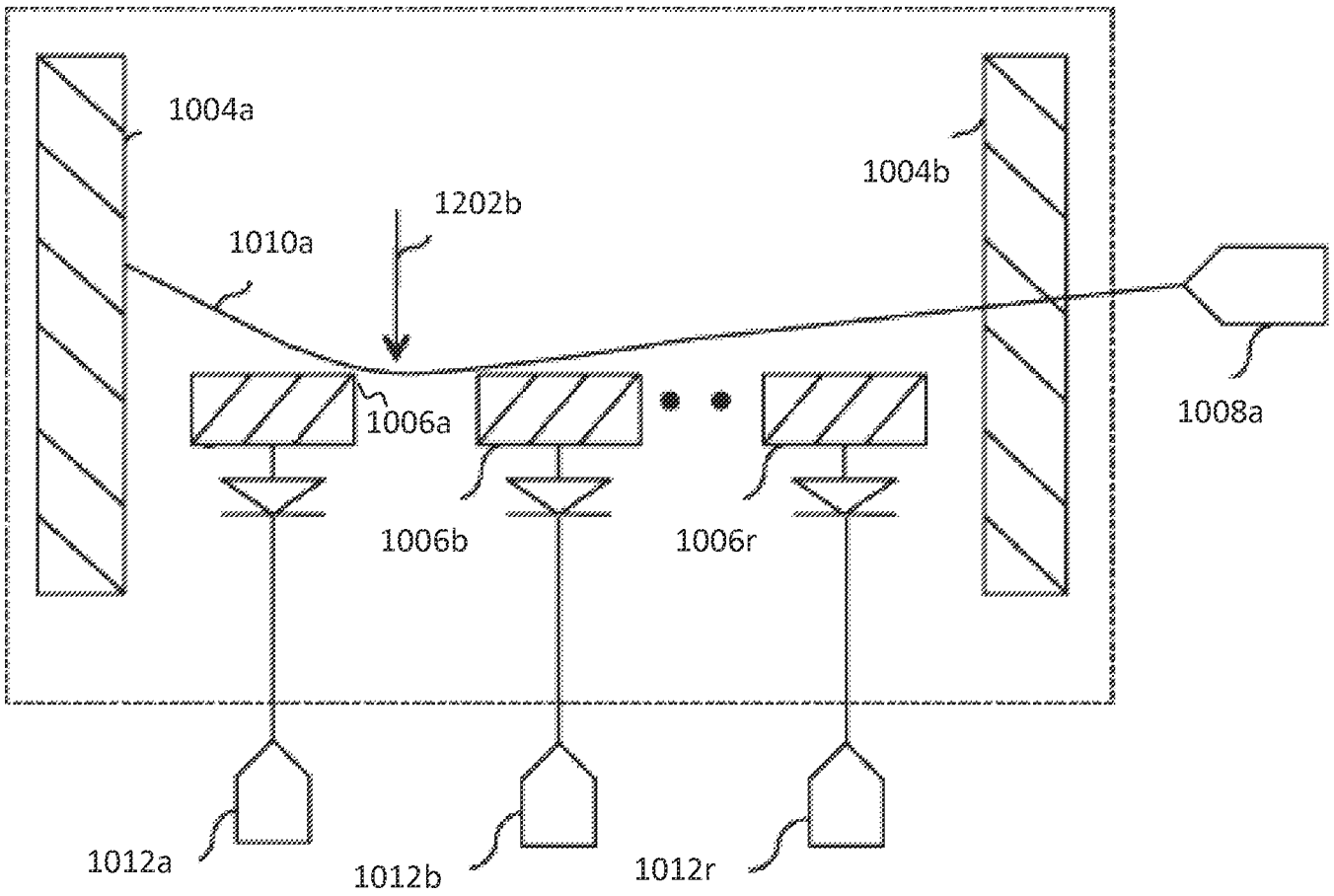
FIG. 12B illustrates another exemplary actuation of the switching system, in accordance with some embodiments of the present technology.

An exemplary perspective view of switching system 904 is illustrated with reference to FIG. 11. Although there can be multiple insulating blocks 1004, only a single insulating block 1004 is illustrated in FIG. 11 for the sake of explanation, and does not restrict the scope of the invention. As illustrated, conductive wires 1010*a-n* are suspended from insulating block 1004 over conductive pads 1006*a-n*. Electrical switches formed by conductive wires 1010*a-n* and conductive pads 1006*a-n* may be actuated as shown with reference to FIGS. 12A and 12B. With reference to FIG. 12A, an exemplary actuation of switches in switching system 904 is explained with only a single conductive wire 1010*a* that may be suspended over conductive pads 1006*a-r*. A person skilled in the art will appreciate that other electrical switches formed by conductive wires 1010*a-n* and conductive pads 1006 *a-n*, may function is similarly. The user may press conductive wire 1010*a* as shown by arrow 1202*a* to contact it with conductive pad 1006*b*. As a result, current flows between first port 1008*a* and second port 1012*b*. Similarly, when the user presses conductive wire 1010*a* to contact with conductive pad 1006*a*, then a current flows between first port 1008*a* and second port 1012*a*. The user may press various conductive wires 1010*a-n* simultaneously. Further, the user may press various conductive wires 1010*a-n* on various conductive pads 1006*a-n* to provide inputs. For example, the user may press conductive wire 1010*a* to contact conductive pad 1006*a* and 1006*r*. The inputs provided by the user are monitored and analyzed by monitoring system 906. With reference to FIG. 12B, another exemplary actuation of the switches in switching system 904 is illustrated. The user may press conductive wire 1010*a* as shown by an arrow 1202*b*. As a result, conductive wire 1010*a* may contact both conductive pads 1006*a* and 1006*b*. Therefore, current flows between first port 1008*a* and second ports 1012*a* and 1012*b*. The user can therefore, provide inputs by contacting a single conductive wire to multiple conductive pads. A person skilled in the art will appreciate that multiple conductive wires may be contacted with multiple conductive pads in the configuration discussed with reference to FIG. 12B to provide inputs. Furthermore, the elements of switching system 904 may be designed to provide the configurations as discussed in conjunction with FIGS. 12A and 12B. The size or area of conductive pads may be designed so that conductive wires can touch multiple conductive pads. For example, a device 902 in the configuration of a guitar, with conductive wires 1010*a-n* suspended over the array of conductive pads, the conductive pads can be configured a guitar frets.

Figure 13:
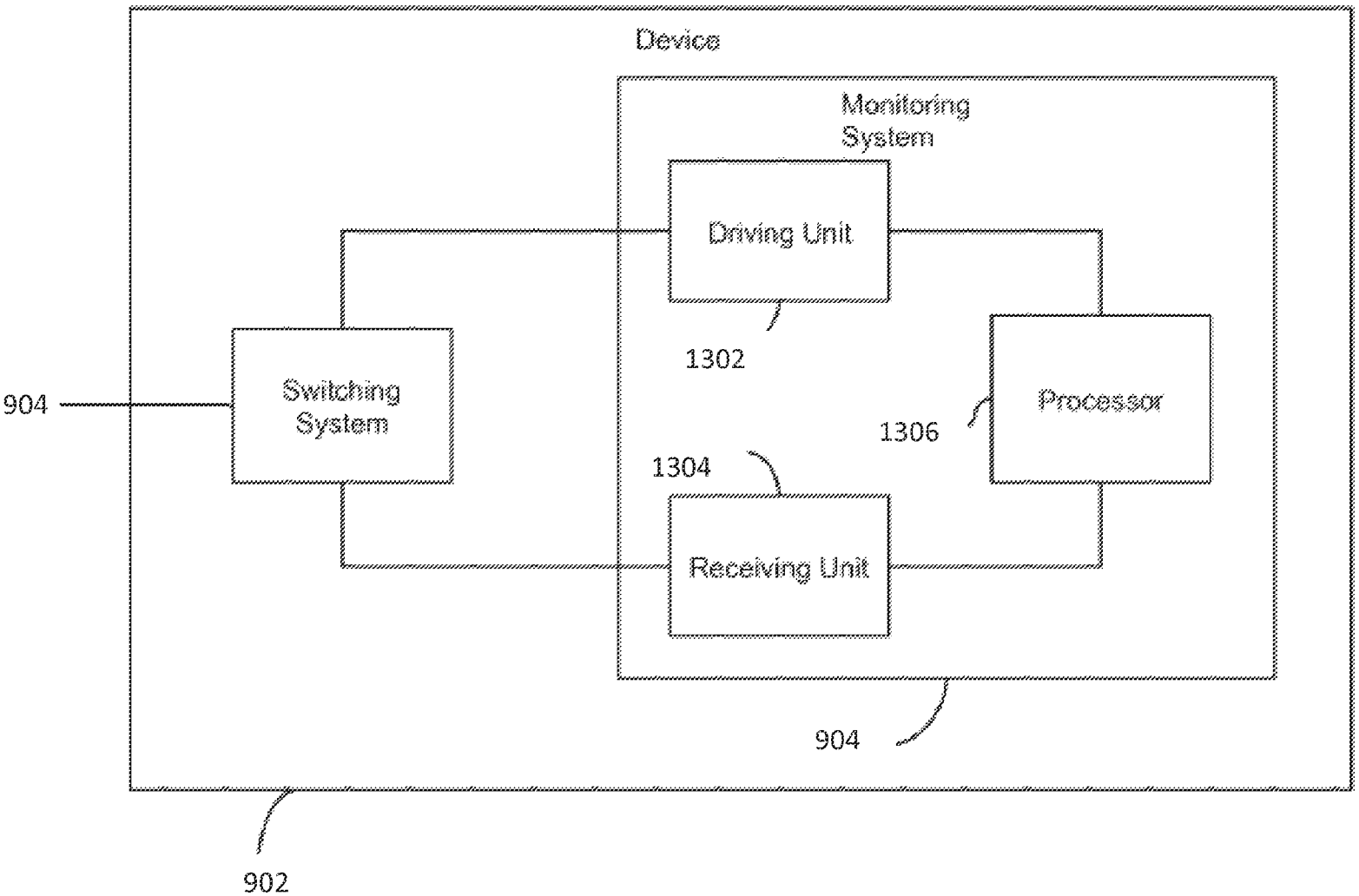
FIG. 13 is a block diagram illustrating various components of an monitoring system of the device, in accordance with some embodiments of the present technology.

FIG. 13 is an exemplary block diagram illustrating various components of monitoring system 906 of device 902. Monitoring system 906 may include a driving unit 1302, a receiving unit 1304 and a processor 1306. In an embodiment of the invention, monitoring system 906 may be implement as an Application Specific Integrated Circuit (ASIC) on device 902.

Driving unit 1302 is connected to first ports 1008*a-n* of switching system 904 to provide electric current or signals to conductive wires 1010*a-n*. Driving unit 1302 provides the current or signals are based on instructions received from processor 1306, this is hereinafter referred to as polling of conductive wires 1010*a-n*. Driving unit 1302 polls conductive wires 1010*a-n* at a pre-defined frequency. The pre-defined frequency may be based on the application of device 902. However, a person skilled in the art will appreciate that the pre-defined frequency is more than the rate at which the user can provide inputs to device 902. In an embodiment of the invention, driving unit 1302 polls conductive wires 1010*a-n* at a dynamic frequency. Therefore, the frequency of the polling may be defined during the functioning of switching system 904. In another embodiment of the invention, driving unit 1302 polls conductive wires 1010*a-n* based on events. Driving unit 1302 polls each conductive wires 1010*a-n* independently. Further, driving unit 1302 may polls each conductive wires 1010*a-n* sequentially. For example, conductive wire 1010*a* may be polled followed by conductive wire 1010*b*, and similarly other conductive wires may be polled. In an embodiment of the invention, the sequence of polling is pre-defined based on the application of device 902. In another embodiment of the invention, the sequence of polling may be adjusted dynamically.

When the user contacts a conductive wire to a conductive pad voltage is induced. Subsequently, the signal or current sent by driving unit 1302 through a first port is received at a second port of switching system 904. For example, as shown with reference to FIG. 12, when conductive wire 1010*a* contacts conductive pad 1010*b*, then the signal is received at second port 1012*b*. Therefore, a conductive wire pressed and the corresponding conductive pad can be judged based on the signal received at second port 1012*b*. However, as discussed above the user may press multiple conductive wires 1010*a-n* on multiple conductive pads 1006*a-n*. Therefore, driving unit 1302 polls each conductive wire 1010*a-n* simultaneously, and corresponding result of the polling are received at receiving unit 1304 through second ports 1012*a-n*.

Receiving unit 1304 may be connected to switching system 904 through second ports 1012*a-n*. Furthermore, receiving unit 1304 may be connected to conductive pins 1016*a-n* through third ports 1018*a-n*. The result received by receiving unit 1304 may be in form of signals or currents. The result is obtained by polling switching system 904, and therefore may indicate an existing status of switching system 904. The existing status of switching system 904 may include an existing status of conductive pads 1006*a-n*. The existing status of conductive pads 1006*a-n* may indicate whether the current or signal is received from conductive pads 1006*a-n*. For example, as shown with reference to FIG. 12, when conductive wire 1010*b* contacts conductive pad 1008*b* then a current or signal of polling may flow to second port 1012*b*. In this case, the existing status of conductive pad 1008*b* may be stored by receiving unit 1304 as 'active'. Similarly, when a current is not flowing the status is stored as 'inactive'. Further, the existing status of switching system 904 may include an existing status of conductive pin 1016. As discussed above, the existing status of conductive pin 1016 can be 'active' or 'inactive' based on whether the current is flowing or not. In an embodiment of the invention, existing status of conductive pin 1016 may include various pre-set parameters associated with conductive pin 1016, such as duration of contact, and so forth. The result may be stored by receiving unit 1304 in a register, in an embodiment of the invention. Driving unit 1302 continuously polls conductive wires 1010*a-n* sequentially and the result of polling is accordingly updated in the register by receiving unit 1304. In an embodiment of the invention, a last status of polling is stored along with the existing status of switching system 904. The last status is here after referred to as previous status of switching system 904.

Processor 1306 analyzes the results stored by receiving system 1304 to generate an output corresponding to the inputs provided by the user. For example, processor 1306 reads the existing status of a conductive pad as 'active' and may correspondingly generate an output associated with the conductive pad. The output may be present to the user as mechanical, visual or audible feedback.

In an embodiment of the invention, processor 1306 compares the previous status with the existing status of switching system 904, to generate an output. For example, the previous status of conductive pins 1016 *a-n* may be compared to the existing status of conductive pins 1016*a-n*. Assuming that the previous status of conductive pins 1016*a-n* was 'active' and the existing status is 'inactive', then processor 1306 may generate output corresponding to existing status of conductive pads 1006*a-n* and conductive pins 1016*a-n*. In an embodiment of the invention, the output is generated by processor 1306 based on pre-set parameters associated with conductive pins 1016*a-n*. Further, processor 1306 may store the previous status of switching system 904 in a register. Processor 1306 may include software or firmware to provide instructions to driving unit 1302 and receiving unit 1304. In an embodiment of the invention, driving unit 1302 and receiving unit 1304 may be electrical or electronic circuits driven on instructions provided by processor 1306. In another embodiment of the invention, driving unit 1302 and receiving unit 1304 may be components of processor 1306.

With the above components and design thereof in mind, it should be appreciated that alternative components, constructions and materials can be used to accomplish the benefits derived from device 902. For example, monitoring system 906 may comprise more than one processor. Further, the functionality of receiving unit 1304 may be incorporated in driving unit 1302. Moreover, driving unit 1302 may be connected to second ports 1012*a-n* and receiving unit 1304 may be connected to first ports 1008*a-n*.

Having discussed the exemplary embodiments and contemplated modifications, it should be appreciated that a method for registering inputs provided by the user and generating a corresponding is also contemplated. According to this method, a device is provided. The device may include a switching system and an monitoring system. The switching may include an array of conductive pads and one or more conductive wires suspended over the array of conductive pads. The monitoring system includes a processor, a driving unit, and a receiving unit.

The driving unit of monitoring system continuously polls the conductive wires of the switching system sequentially. Therefore, when the user presses the conductive wires to contact the conductive pads, the receiving unit may receive a result of polling. The result of polling may include an existing status of the switching unit. The existing status of the switching unit may include an existing status of the conductive pads. In an embodiment of the invention, the existing status of the switching system may further include an existing status of multiple conductive pins connected to third ports. Further, the receiving unit may store the result in a register. Moreover, the receiving unit may store a previous state of the switching system in the register.

Thereafter, the processor processes the result of polling to generate an output corresponding to the inputs provided by the user. In an embodiment of the invention, the processor compares the existing status to the previous status. Thereafter, the output is generated based on the difference in the previous status and the existing status. For example, the previous state of the conducting pins is compared with the existing state of the conducting pins, and correspondingly an output is generated based on the existing status of the conductive pads and the pre-set parameters associated with the conductive pins. In an embodiment of the invention, the processor may store the result of polling in a register.

The foregoing disclosure explains exemplary systems and method for detecting contact between wires in a suspended array and an array of conductive contacts. Additionally, in some embodiments of the present technology, additional techniques are used to improve the accuracy of a detection circuit. For example, one or more location or proximity sensors can be employed in addition to the contact detection circuit.

In some embodiments of the present technology the array of lighting elements can include one or more proximity sensors to detect when a contact is about to be touched. For example, one or more infrared (IR) proximity sensors can be used. An IR proximity sensor can modulate an IR signal emitted from a pair of IR LEDs and can also detect the modulated IR signal reflected back from a nearby object.

In addition to detecting one or more contacts with an array of contacts, the present technology can involve detecting contact with the conductive wires themselves. A number of techniques can be used to detect contact with the wires including, but not limited to an external contact, piezoresistive sensors and circuitry coupled with the wires, piezoelectric sensors and circuitry coupled with the wires, signal processing circuits, digital signal processing modules, etc.

Figure 14:
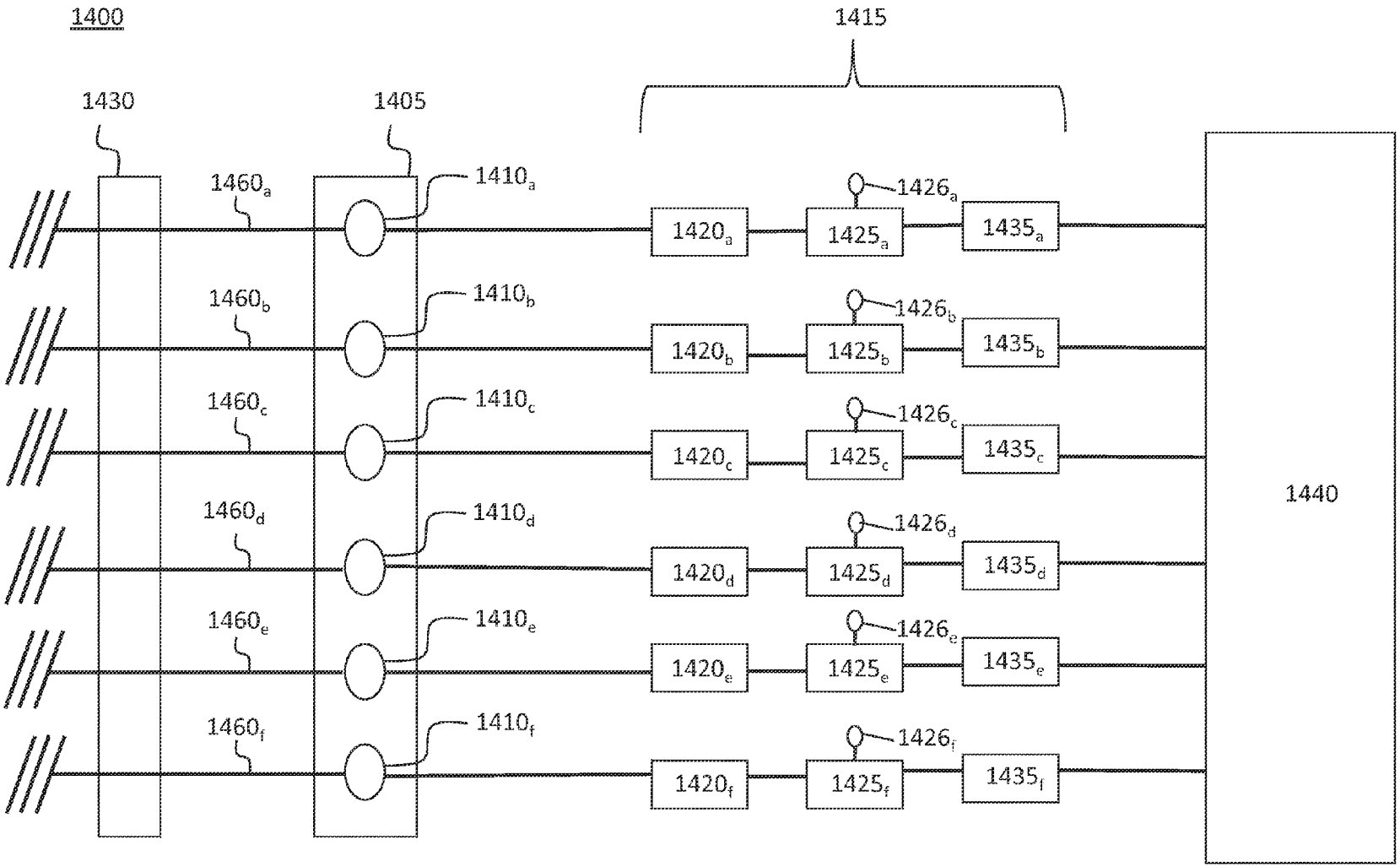
FIG. 14 illustrates an exemplary system for analyzing mechanical inputs using piezoelectric sensors according to some embodiments of the present technology.

For example, FIG. 14 illustrates an exemplary system 1400 for analyzing mechanical inputs using piezoelectric sensors according to some embodiments of the present technology. The system 1400 includes conductive wires $\mathbf{1460}_{a\text{-}f}$ coupled with an array of piezoelectric sensors $\mathbf{1410}_{a\text{-}f}$ contained in a housing 1405, e.g. a bridge of an instrument. The piezoelectric sensors $\mathbf{1410}_{a\text{-}f}$ can convert force and vibration of the conductive wires $\mathbf{1460}_{a\text{-}f}$ into an analog voltage signals that are fed into a signal processing subsystem 1415. Furthermore, the system 1400 can detect physical contact of the conductive wires $\mathbf{1460}_{a\text{-}f}$ even when they are not depressed onto one or more piezoelectric sensors $\mathbf{1410}_{a\text{-}f}$. For example, a signal of a known frequency can be pushed onto a wire and the system 1400 can detect changes to the RC characteristics.

The signal processing subsystem 1415 is configured to interpret the analog voltage signals to determine when the conductive wires $\mathbf{1460}_{a\text{-}f}$ are plucked and how hard they are plucked.

In the case of conductive wires $\mathbf{1460}_{a\text{-}f}$ of various masses and tension (e.g. guitar strings), the wires will vibrate at different frequencies. Consequently, the signal processing subsystem 1415 includes a group of bandpass filters $\mathbf{1420}_{a\text{-}f}$ having varied cutoff frequencies depending on the conductive wire that is connected thereto. In the case of musical instrument strings, the cutoff frequencies generally relate to a range of frequencies produced by plucking the respective strings.

The group of bandpass filters $\mathbf{1420}_{a\text{-}f}$ is electrically coupled with a group of peak detectors $\mathbf{1425}_{a\text{-}f}$ and respective bandpass filters 1420 pass vibrations in the cutoff frequency range to corresponding peak detectors 1425. The peak detectors $\mathbf{1425}_{a\text{-}f}$ are configured to isolate actual wire plucks from attenuation.

Each of the peak detectors $\mathbf{1425}_{a\text{-}f}$ can also be coupled with a potentiometer $\mathbf{1426}_{a\text{-}f}$, respectively. The potentiometers $\mathbf{1426}_{a\text{-}f}$ can be used to adjust capacitance in the peak detectors $\mathbf{1425}_{a\text{-}f}$, thereby allowing control and adjustment of when voltages are detected as actual plucks as opposed to attenuation. In some cases, the potentiometers $\mathbf{1426}_{a\text{-}f}$ can be adjusted to specifically address a ripple effect when a conductive wire 1460 is plucked quickly.

The system 1400 can also include an insulated mute 1430 is positioned between an area where the conductive wires $\mathbf{1460}_{a\text{-}f}$ are plucked and the piezoelectric sensors $\mathbf{1410}_{a\text{-}f}$ detect vibration. The mute 1430 can be a dampening material (e.g. rubber) that reduces attenuation in the conductive wires $\mathbf{1460}_{a\text{-}f}$.

Additionally, in some embodiments of the present technology, the signal processing subsystem 1415 and/or a control unit 1440 can also include one or more digital signal processing software modules $\mathbf{1435}_{a\text{-}f}$. The digital signal processing software modules $\mathbf{1435}_{a\text{-}f}$ can be configured to perform further signal processing such as note queuing, windowing, detection of pitch deviation, articulation deviation, cross talk between conductive wires $\mathbf{1460}_{a\text{-}f}$, etc. Also, in some embodiments, the digital signal processing software modules $\mathbf{1435}_{a\text{-}f}$ can replace one or more of the analog signal processing components (e.g. the peak detectors $\mathbf{1425}_{a\text{-}f}$). After a voltage signal is processed by the signal processing subsystem 1415, a control unit 1440 receives the processed signals.

Figure 15:
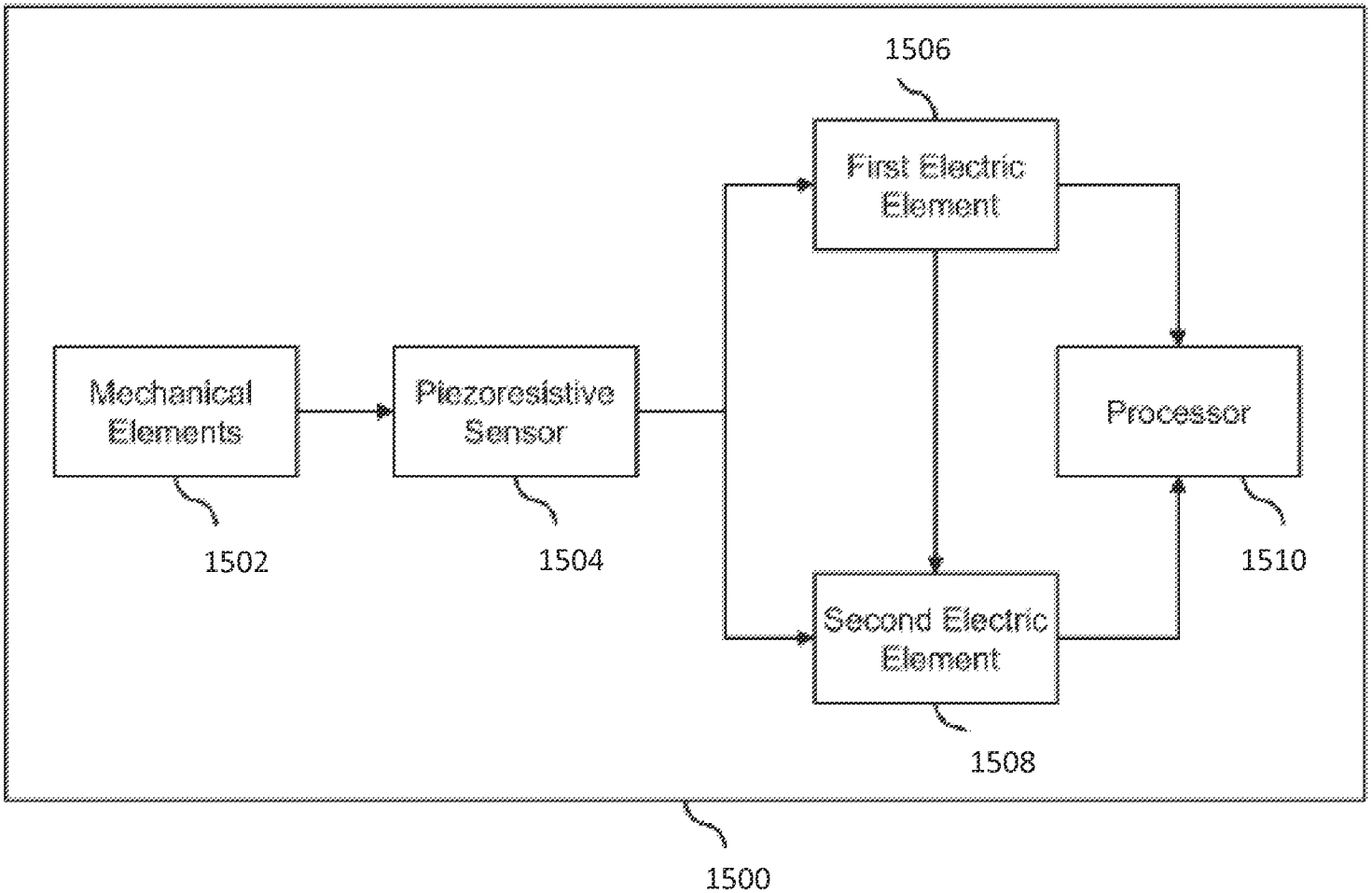
FIG. 15 illustrates an apparatus for analyzing mechanical inputs, in accordance with some embodiments of the present technology.

In other embodiments, the detection of contact with conductive wires involves piezoresistive sensors coupled with the wires. With reference to FIG. 15 an apparatus 1500 for analyzing mechanical inputs is illustrated, in accordance with an embodiment of the invention. Apparatus 1500 can determine and analyze various characteristics of mechanical inputs, for example, tension and mechanical vibrations by converting them to electric signals. Mechanical elements 1502 of apparatus 1500 determine or receive the mechanical inputs. Examples of mechanical elements 1502 include, but are not limited to, strings, beams, cantilevers, or other mechanical elements that can sustain mechanical stress due to tension and vibrations. Each of mechanical elements 1502 is connected to a piezoresistive sensor 1504. In an embodiment of the invention, mechanical elements 1502 may be connected to a single piezoresistive sensor. Further, mechanical elements 1502 may be under mechanical stresses or provided a predefined tension before applying the mechanical inputs.

Piezoresistive sensor 1504 generates electric signals based on the mechanical inputs. It is well known that the resistance of piezoresistive materials change based on the amount of physical deformation. Therefore, when mechanical inputs are provided to mechanical elements 1502, the resistance of piezoresistive material in piezoresistive sensor 1504 changes and corresponding electric signals are generated. The electric signals may be then analyzed by a first electric element 1506 (hereafter referred to as first element 1506) and a second electric element 1508 (hereafter referred to as second element 1508) to generate two voltage components of the electric signals.

First element 1506 may determine an average voltage value for the electric signal. In an embodiment of the invention, first element 1506 may be a low pass filter that eliminates electric signals having frequencies higher than a predefined frequency level to calculate the average voltage. For example, electric signals with a frequency less than 10 Hz may be filtered out (e.g. using low pass filters, RMS detection, or zero crossing techniques). The average voltage corresponds to an average or a constant tension in mechanical elements 1502. Further, the average voltage may remain same when a constant force is applied and changes when the constant force changes. For example, when mechanical elements 1502 are displaced and thus applying a constant tension. Further, the electric signals may include transient voltages, for example, the voltages generated by vibrations of mechanical elements 1502.

Second element 1508 analyzes the electric signals for the transient voltages in the electric signal. The average voltage value is sent from first element 1506 to second element 1508. Thereafter, the values of the transient voltages may be determined based on the average voltage value. For example, the transient voltage values may include values that are centered about zero after eliminating the average voltage values from the electric signal. In an embodiment of the invention, second element 1508 may be a high-pass filter or a biased high-pass filter that filters out electric signals having frequencies lower than the predefined frequency level. For example, electric signals with a frequency less than 10 Hz may be filtered out. Furthermore, second element 1508 may filter out the electric signals that have frequencies outside a predefined frequency range. For example, electric signals with a frequency outside the range of 50 Hz to 100 Hz may be filtered out. The transient voltage values may be generated by vibrations of mechanical elements 1502. In an embodiment of the invention, apparatus 1500 may include a converter for converting the outputs of first element 1506 and second element 1508 from analog to digital. Exemplary electric signals and voltage components are illustrated in conjunction with FIGS. 18A, 18B, and 18C.

Thereafter, the transient voltage values and the average voltage values are sent to a processor 1510. Processor 1510 may then process the voltage component including the transient voltages and the average voltage to determine the characteristics of the mechanical inputs, such as tension and vibrations. For example, processor 1510 may determine the magnitude and articulation of mechanical elements 1502 based on the outputs of first element 1506 and second element 1508. Furthermore, processor 1510 may determine complex mechanical inputs based on the time information of the vibrations. The time information may be for example, the time required by mechanical element 1502 to reach a highest frequency, time for which a frequency is sustained, time to drop to a previous frequency and so forth. Furthermore, processor 1510 may calibrate piezoresistive sensor 1504 based on the average voltage level. For example, mechanical elements 1502 may be provided a tension before applying mechanical inputs. Therefore, processor 1510 may use the average voltage information to calibrate apparatus 1500.

Figure 16:
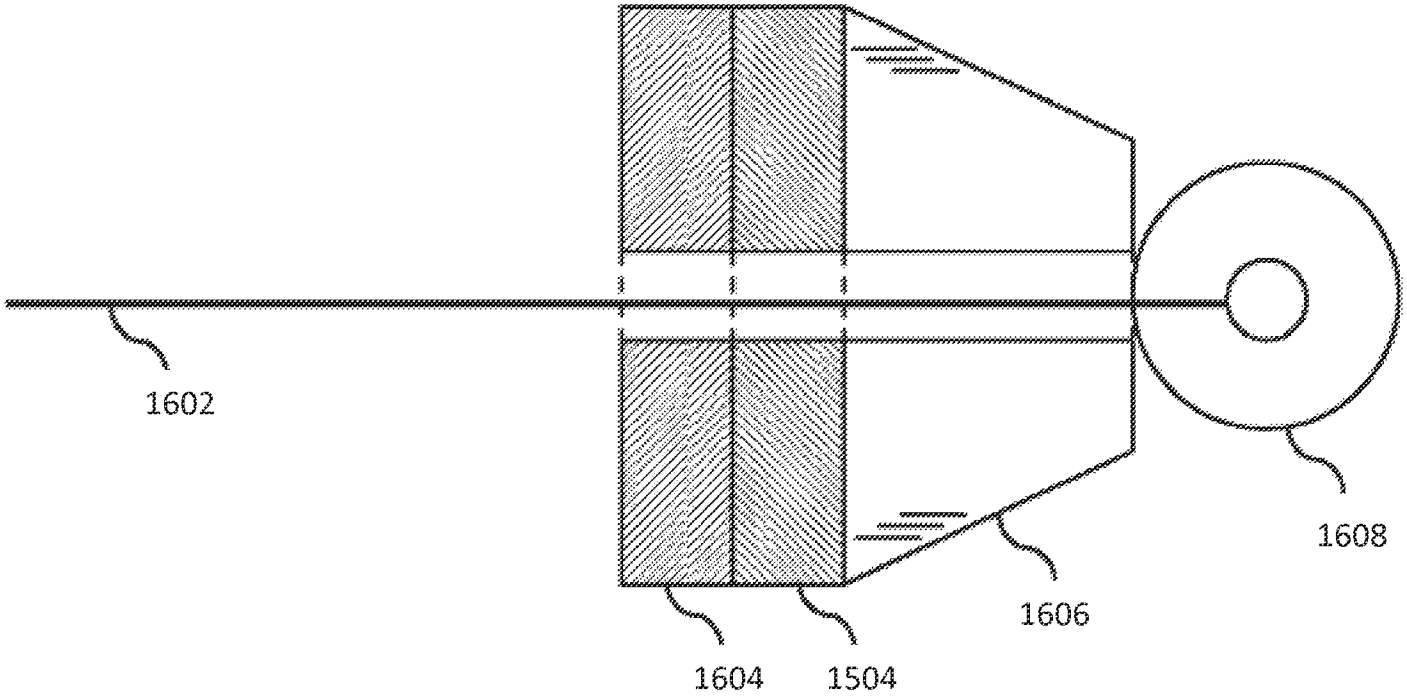
FIG. 16 illustrates an arrangement for determination of mechanical inputs, in accordance with some embodiments of the present technology.

An exemplary arrangement for determination of mechanical inputs is illustrated with reference to FIG. 16. As shown, the mechanical element is in the form of a string 1602 that determines mechanical inputs. String 1602 is connected at one end to a ring 1608 that can be used to make string 1602 tight or loose. Further, ring 1608 exerts pressure on piezoresistive sensor 1504 through pressure distribution element 1606. As shown, the shape of pressure distribution element 1606 is trapezoidal to uniformly distribute the pressure on the surface of piezoresistive sensor 1504. However, a person skilled in the art will appreciate that any other suitable shape can be selected. Therefore, piezoresistive sensor 1504 may be fixed between pressure distribution element 1606 and a block 1604. Block 1604 may be for example, a supporting structure of an apparatus for analyzing the mechanical inputs. When string 1602 is stressed, for example, by vibrations or tension, then the stress is transferred to piezoresistive sensor 1504. As a result, the resistance of the material of piezoresistive sensor 1504 changes. The changes in the resistance are used to generate electric signals. The electric signals may be generated in the electric circuit of piezoresistive sensor 1504, which is shown with reference to FIGS. 17A and 17B.

Figure 17A:
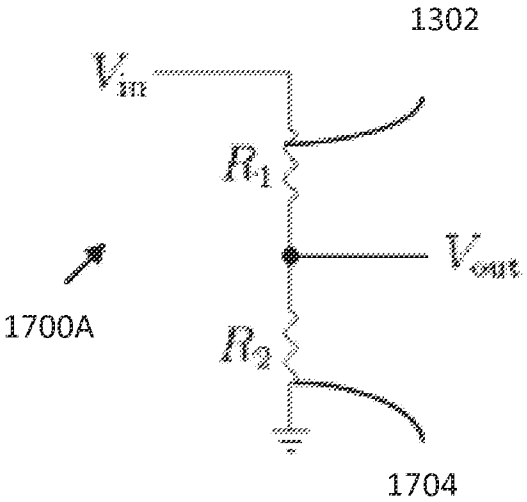
FIGS. 17A and 17B illustrate exemplary circuit diagrams for converting mechanical inputs to electric signals.

FIG. 17A illustrates an exemplary circuit 1700A for converting the mechanical inputs to electric signals from piezoresistive sensor 1504. Circuit 1700A represents a typical resistive-divider that produces an output voltage (Vout) that is a fraction of the input voltage (Vin). The Vin may be provided to piezoresistive sensor 1504 from power source, for example, but not limited to a battery.

Circuit 1700A may include a resistor R1 1702 and a resistor R2 1704. Resistor R2 1704 may correspond to the resistance of piezoresistive sensor 1504. Further, as discussed above the resistance of piezoresistive sensor 1504 may change based on the stresses. The mathematical equation for output voltage in this case is:

$$Vout=(R2/(R1+R2))*Vin$$

As a result, the value of Vout may change based on the resistance of piezoresistive sensor 1504. Further, the value of the voltage may change frequently based on the type of stress. For example, the voltage may remain constant at a particular level in case of tension, whereas the voltage may fluctuate in case of vibrations in the mechanical elements.

Figure 17B:
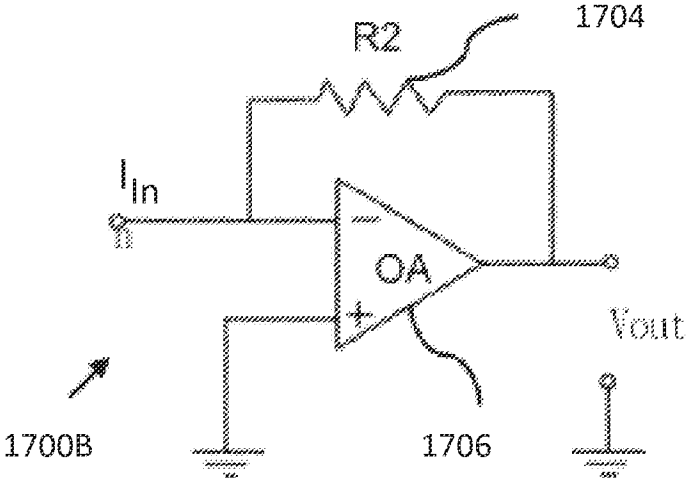

FIG. 17B illustrates an exemplary circuit 1700B for converting the mechanical inputs to electric signals from piezoresistive sensor 1504. As discussed above, resistor R2 1704 may correspond to the resistance of piezoresistive sensor 1504. Further, as discussed above the resistance of piezoresistive sensor 1504 may change based on the stresses. Therefore, R2 1704 may be used as a current source by connecting it to an Operational Amplifier (OA) 1706.

In this case, OA 1706 may amplify the current Iin provided to R2 1704. Further, Iin may be converted to voltage Vout. The mathematical equation for output voltage in this case is:

$$Vout=-Iin*R2$$

Therefore, better control may be applied to the current and voltage changes. As a result, the mechanical inputs may be detected with a greater accuracy. Although, limited examples of circuit are discussed, a person skilled in the art will appreciate that other circuit may be used to detect the changes in voltage or current without deviating from the scope of the invention. Exemplary waveforms for electric signals corresponding to the mechanical inputs are illustrated with reference to FIGS. 18A, 18B, and 18C.

Figure 18A:
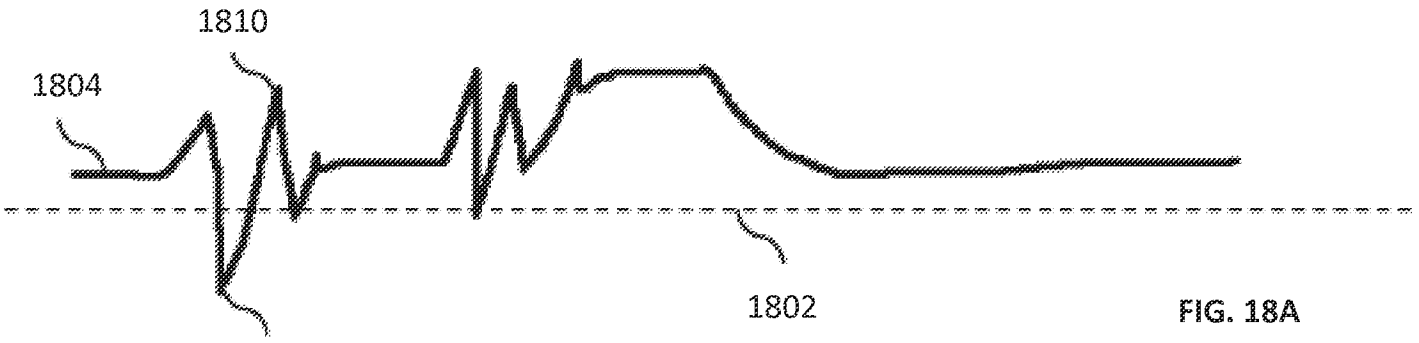
FIGS. 18A, 18B, and 18C illustrate exemplary electric signals and components corresponding to mechanical inputs.

FIG. 18A illustrates values of Vout as a waveform. As shown in FIG. 18A, a voltage line 1802 may represent an initial level of tension that may be provided to the mechanical elements before applying mechanical inputs. For example, the mechanical element may be tuned to a particular stress level such that voltage line 1802 indicates a voltage of 0.5 volts. A person skilled in the art will appreciate that the mechanical elements can be tuned to any initial stress level or voltage based on the application of the apparatus. A waveform 1804 may be generated based on the voltage fluctuations when the mechanical inputs are provided to the mechanical elements as discussed above. Waveform 1804 may include peaks such as a high peak 1810 and a low peak 1812. For example, high peak 1810 may be generated when the stress is more that the initial stress and low peak 1812 may be generated when the stress is less that the initial stress. Generally, low peak 1812 is generated because the initial stress may be relieved by the mechanical inputs.

Figure 18B:
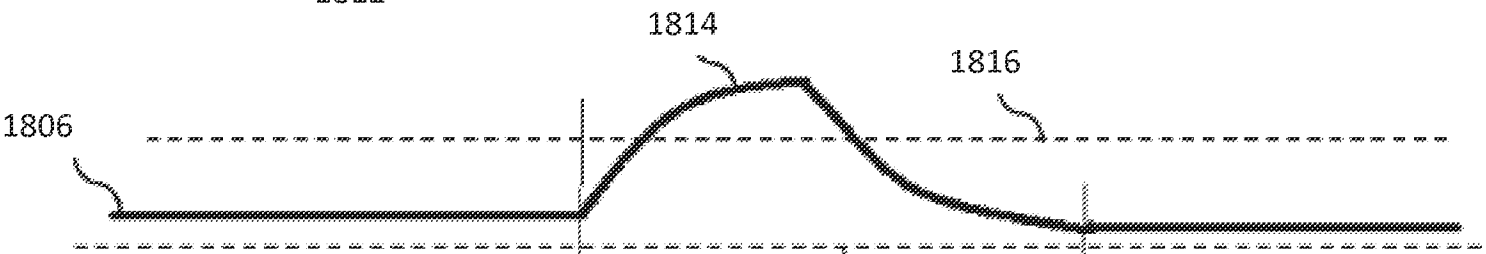
Figure 18C:
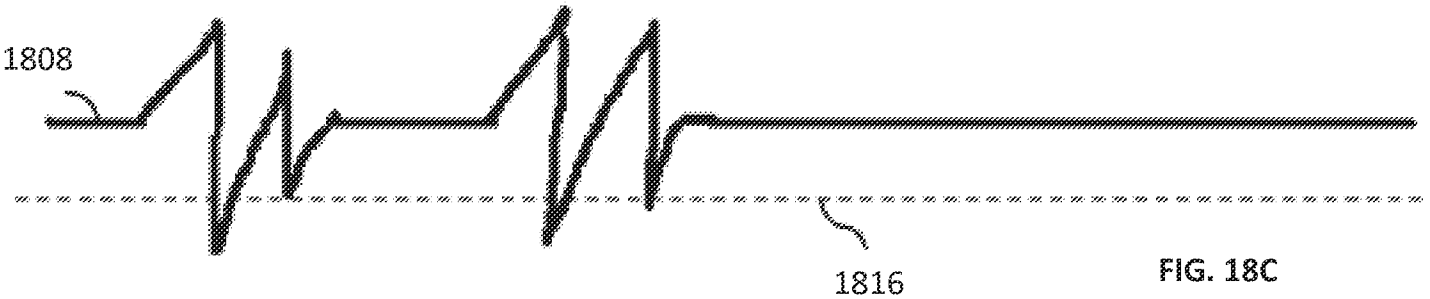

FIG. 18B and FIG. 18C illustrate waveforms for the voltage components that are analyzed by first element 1506 and second element 1508. As shown in FIG. 18B, waveform 1804 may be analyzed by first element 1508 to generate a waveform 1806. Waveform 1806 may be formed by filtering out the voltages having frequencies higher than the predefined frequency level. A peak 1814 may represent an increased stress that corresponds to tension in the mechanical elements. Furthermore, a voltage line 1816 may indicate the average voltage level.

Further, as shown in FIG. 18C, waveform 1804 may be analyzed by second element 1508 to generate a waveform 1808. Waveform 1808 may be formed from the voltage component received by filtering out the voltages having frequencies lower than the predefined frequency level. Furthermore, the average voltage level from first element 1506 may be used by second element 1508 to generate waveform 1808 and determine the vibrations in the mechanical elements.

Figure 19:
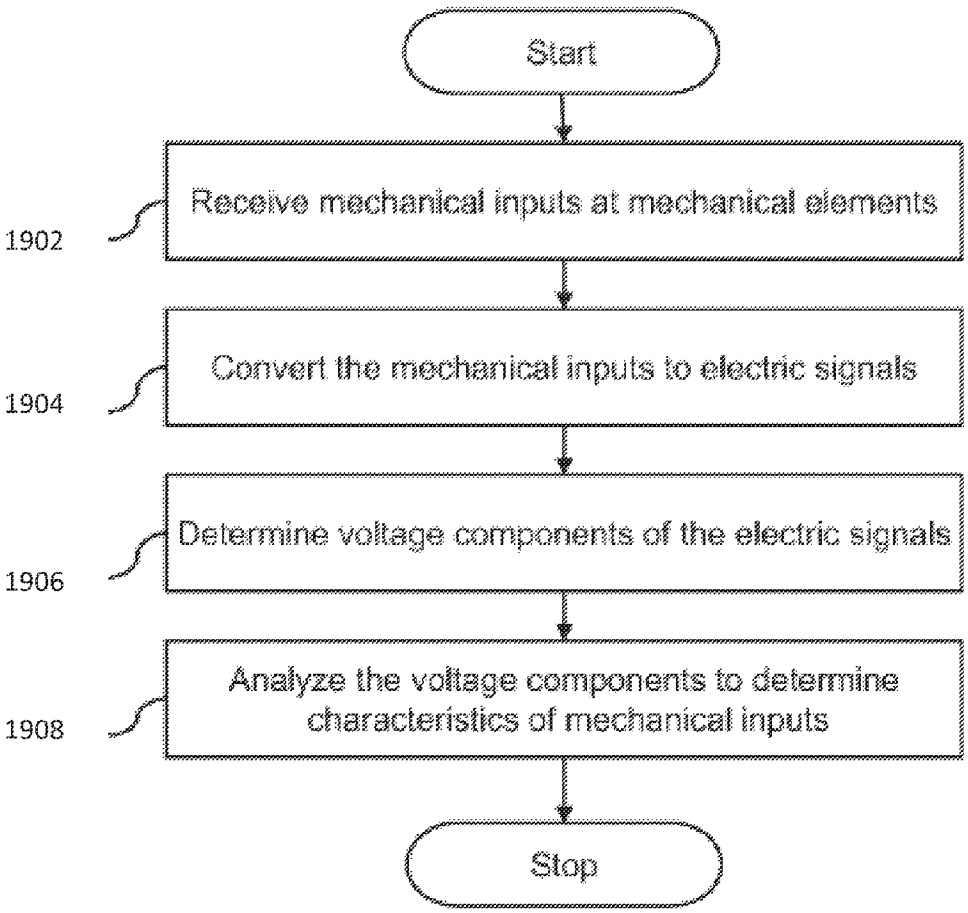
FIG. 19 is a flowchart illustrating the process of analyzing the mechanical inputs, in accordance with some embodiments of the present technology.

FIG. 19 is a flowchart illustrating the process of analyzing the mechanical inputs, in accordance with an embodiment of the invention. At step 1902, mechanical inputs are received at mechanical elements. The mechanical inputs may be for example tension and vibrations in the mechanical elements. Thereafter, at step 1904 the mechanical inputs are converted to electric signals based on the characteristics by a piezoresistive sensor.

At step 1906, the electric signals may be analyzed by a first electric element and a second electric element. The analysis may be performed to determine voltage components of the electric signals. The first electric element may determine an average voltage value for the electric signal. In an embodiment of the invention, first electric element may be a low pass filter that eliminates electric signals having frequencies higher than a predefined frequency level to calculate the average voltage. For example, electric signals with a frequency less than 10 Hz may be filtered out. The average voltage corresponds to an average tension in mechanical elements. Further, second electric element may analyze the electric signals for the transient voltages in the electric signal. The average voltage value is sent from the first electric element to the second electric element. Thereafter, the values of the transient voltages may be determined based on the average voltage value. For example, the transient voltage values may include values that are centered about zero after eliminating the average voltage values from the electric signal. In an embodiment of the invention, the second electric element may filter out electric signals having frequencies lower than the predefined frequency level. For example, electric signals with a frequency less than 10 Hz may be filtered out.

At step 1908, the voltage components generated by the electric elements are analyzed by a processor to determine mechanical inputs. For example, the processor may determine the magnitude and articulation of the mechanical elements based on the outputs of first electric element and the second electric element. Furthermore, the processor may determine complex mechanical inputs based on the time information of the vibrations.

Registering Inputs

As explained herein, there are a variety of ways to detect contact between a wire and one or more conductive pads in an array and to detect vibrations in a wire. However, in some cases, not all detected signals are registered as input. For example, in some embodiments of the present technology, a minimum noise is required for a signal to be registered as an input (e.g. to prevent sounds from electronic components from being registered). Also, in the case of the input device comprising a representation of a stringed instrument (e.g. a guitar), the control circuit 1440 will receive multiple signals, each representing vibration of the conductive wire. However, plucking on a wire can cause mechanical coupling of vibrations, aka cross talk. In other words, the wire vibrations in one wire can be transferred to the other wires. At or around the same time that a wire hears cross talk, the wire can be attenuating from a previous pluck or receiving a new input. Accordingly, vibration in a single wire can be caused by plucking the wire and by vibrations from another wire. In some cases, cross talk can account for a majority (e.g. 60%) of a signal. Consequently, without accounting for cross talk can cause the control unit 1440 to interpret a signal from wire that is caused by cross talk as a true signal that is caused by that wire being plucked. Therefore, there is a need to determine which signals are caused by actual plucking events and which are due to cross talk.

Some embodiments of the present technology involve determining, for each wire in a group of stings in a suspended wire switch array, the extent to which the wire contributes to a voltage signal produced in every other wire due to the dynamic coupling of vibrations. The degree to which a wire contributes to vibration in another wire can be expressed as a proportion or percentage of the amplitude value for the other strings. For example, a given percentage of a voltage signal received from first wire vibrating can be caused by the vibration from a second wire. Some embodiments of the present technology involve empirically testing a population of input devices by plucking wires one at a time to determine a degree to which the wire plucks cause vibrations in each of the other wires. The empirical results can then be used to cancel inputs from a wire with an amplitude that does not exceed a predetermined threshold percentage of the amplitude of another wire.

Figure 20:
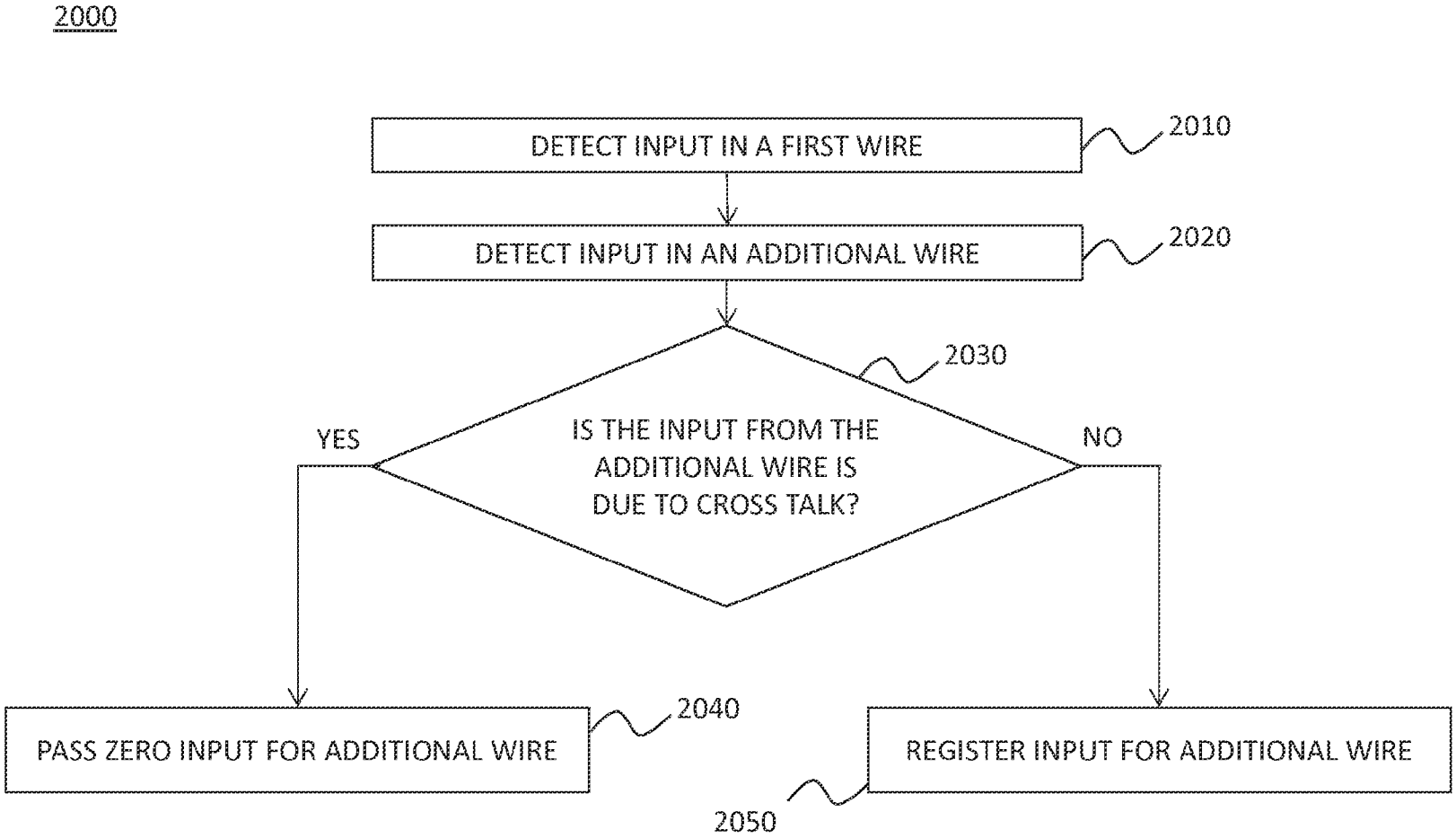
FIG. 20 illustrates an exemplary method of cancelling inputs attributed to dynamic coupling of vibrations from intended inputs according to some embodiments of the present technology.

FIG. 20 illustrates an exemplary method 2000 of cancelling inputs attributed to dynamic coupling of vibrations from intended inputs according to some embodiments of the present technology. The method 2000 involves detecting an input from a first wire 2010 and detecting an input from an additional wire 2020. The method 2000 also involves determining if the input from the additional wire is due to cross talk 2030 from the first wire using a dynamic threshold amplitude. More specifically, the determination 2030 can involve determining whether the amplitude of the additional input exceeds a predetermined threshold percentage of the amplitude of the input from the first wire that can be attributed to the cross talk from the first wire.

The method 2000 can pass a zero signal 2040 to the control unit if the input from the additional wire is attributed to cross talk and, conversely, can register the input from the additional wire 2050 if the dynamic threshold was met or exceeded. Because the amplitude of inputs from the wires is dynamic, the proportional threshold amplitude required to pass along an input from other wires is also dynamic. Additionally, this determination can be made using empirically derived data, as explained above.

Of course, a similar method can be used to determine whether or not to attribute the input in the first wire to cross talk from the additional wire. Indeed, the terms "first" and "additional," as they relate to the discussion of the mechanical coupling of vibrations, should not be read to imply temporal order. For example, some times an input from a first wire occurs earlier in time than the input from the additional wire. In this case, a zero signal can simply nullify the additional input. However, the additional input can sometimes occur before the input from the first wire such that the amplitude of the input from the first wire sets the threshold amplitude higher than the amplitude of the additional input. Consequently, some embodiments of the present technology involve creating temporal windows for storing potential notes to pass on and waiting for the window to close without receiving an additional input that indicates that one or more of the potential notes in the window was actually created by cross talk. In some embodiments, the window is dynamically altered to be longer or shorter to minimize the degree that a human player would be able to play with such frequency while increasing this window every time an input is detected. In other words, a determination of which input is the actual pluck until the algorithm settles within the window. So until the window elapses, at every point an input is detected, cross talk or otherwise, a certain increment is added to the window. Both the baseline window and increment can be altered through software calibration as well.

As explained above, the signal processing subsystem 1415 and/or a control unit 1440 can be configured to account for cross talk between conductive wires $\mathbf{1460}_{a\text{-}f}$. Additionally, the predetermined, dynamic thresholds, the timing of the window, etc. can be modified manually, modified by an application running an external host or modified using hardware, firmware, or software updates. For example, an update to a software application (e.g. 2527) can be used to change the thresholds used to detect cross talk.

Processing Inputs into Musical Notes

Figure 21:
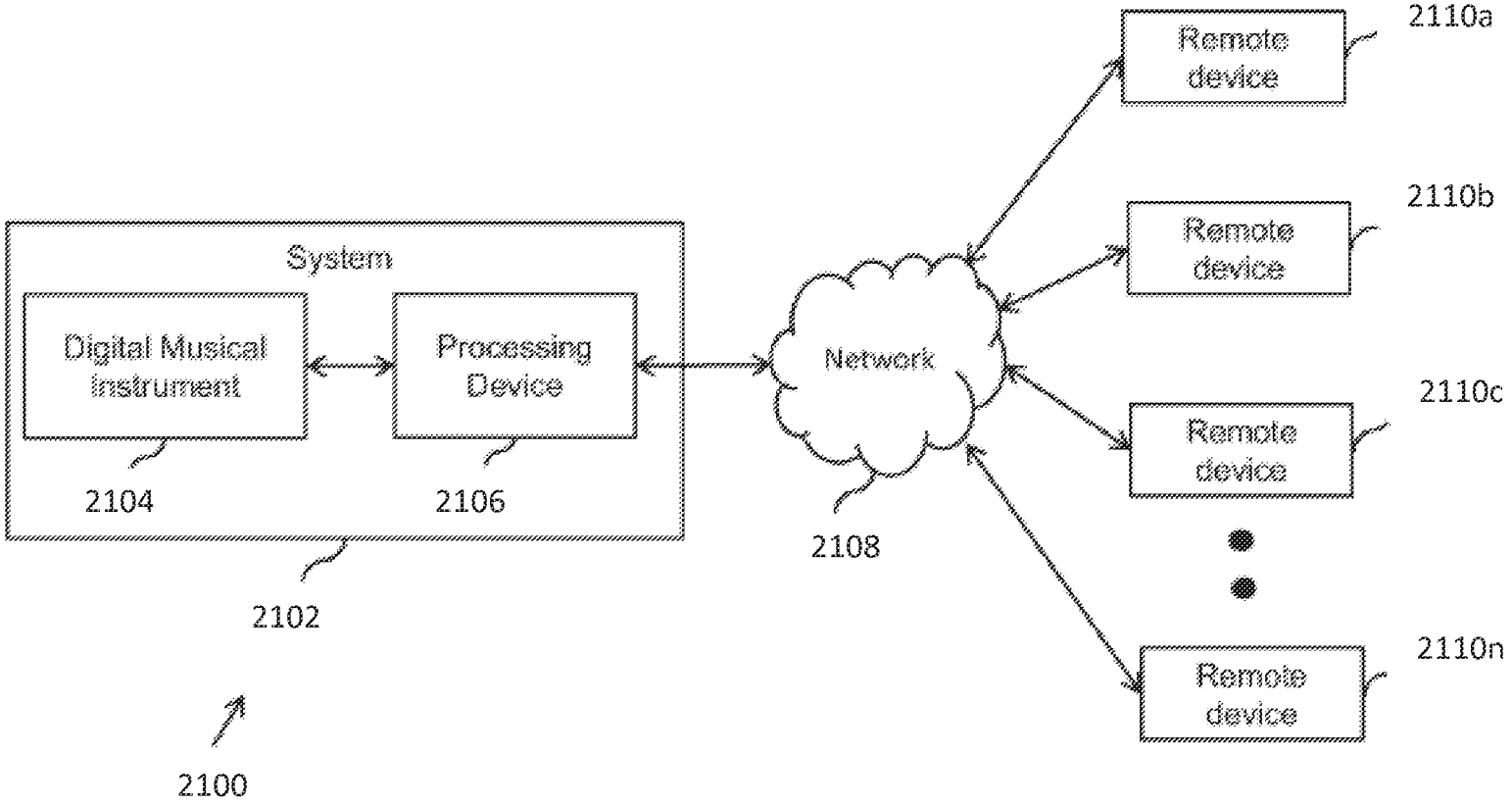
FIG. 21 illustrates an environment where various embodiments of the present invention function, in accordance with some embodiments of the present technology.

With reference to FIG. 21 an environment 2100 is illustrated where various embodiments of the present invention function, in accordance with an embodiment of the invention. Environment 2100 includes a system 2102, a network 2108 and remote devices 2110*a-n*. A user may interact with a digital musical instrument 2104 of system 2102. Digital musical instrument 2104 (here after referred to as instrument 2104) includes a stringed musical instrument, such as but not limited to, a guitar, a lute, a vihuela, a violin, a cello and so forth. A user may interact with instrument 2104 by using the strings to select or play a musical note. Further, instrument 2104 is digital. Therefore, the inputs to and outputs from instrument 2104 are digital. For example, digital signals are generated when the user presses the strings on a fretboard by using fingers or any other object. The digital signals may include information regarding the position of contact of the string with the fretboard. For example, the digital signals may include the position of the finger where a string is contacted with the fretboard. In an embodiment of the invention, the digital signals may include additional information such as the time and duration of the contact of the string with the fretboard.

The digital signals (here after referred to as signals) are then transmitted to processing device 2106 of system 2102. The signals may be transmitted over a wired connection and/or a wireless connection. Examples of wireless connection include but are not limited to a Radio Frequency (RF), Infrared, a Bluetooth connection and so forth. In an embodiment of the invention, the signals may be transmitted to processing device 2106 over a computer network such as the Internet. Processing device 2106 includes a device capable of processing the digital signals to generate musical notes and/or musical notation. For example, the musical notation includes tablature. Tablature is well known a form of musical notation that indicates the finger positions on a musical instrument rather than musical pitches.

Examples of processing device 2106 include, but are not limited to, a computer, a laptop, a mobile phone, a smart phone, Digital Audio Workstation (DAW) and so forth. Further, processing device 2106 may be connected to remote devices 2110*a-n* through network 2108. Examples of network 2108 include, but are not limited to, a Local Area Network (LAN), a Wireless Local Area Network (WLAN), a Wide Area Network (WAN), the Internet and so forth. Processing device 2106 may communicate with remote devices 2110*a-n* for information such as musical notes, information about finger position and so forth. In an embodiment of the invention, device 2110*a-n* may process the signals received from processing device 2106 to generate musical notes and/or notation. Examples of remote devices 2110*a-n* include, but are not limited to, a computer, a laptop, a mobile phone, a Smartphone, a server and so forth.

Figure 22:
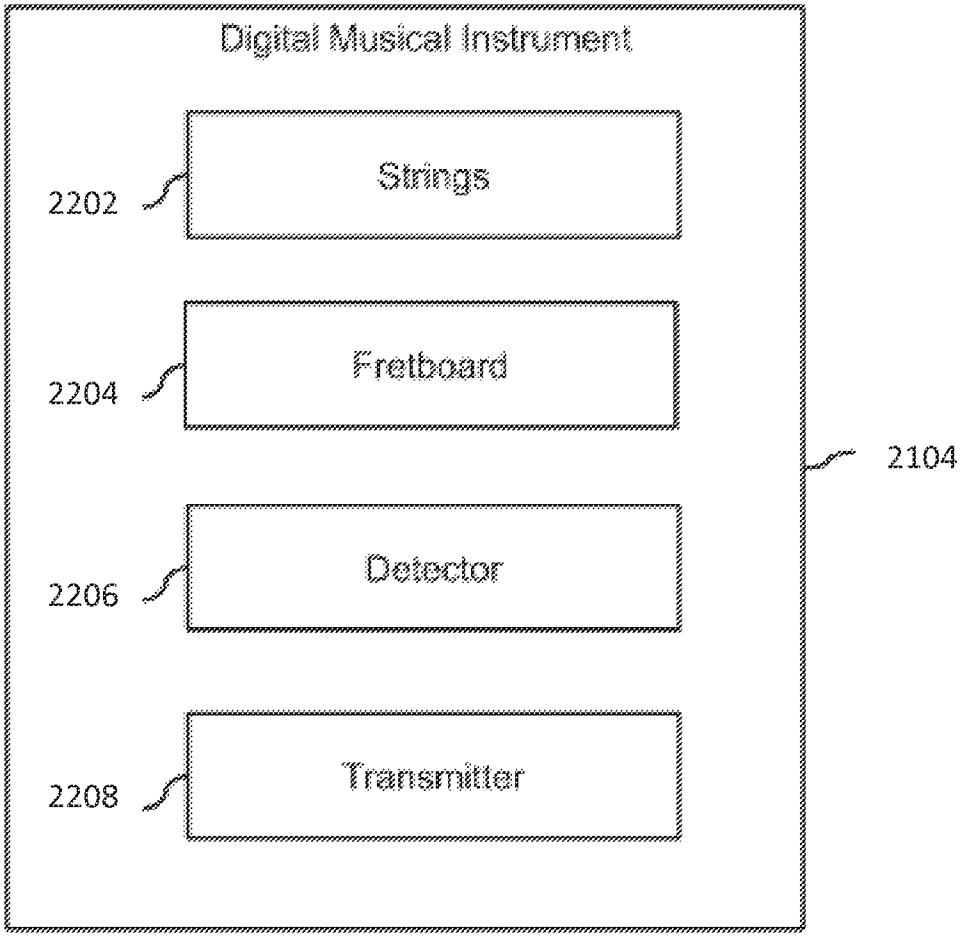
FIG. 22 illustrates elements of a digital musical instrument, in accordance with some embodiments of the present technology.

FIG. 22 illustrates exemplary components of instrument 2104 for generating the signals. The user may interact with instrument 2104 by using strings 2202 extended over a fretboard 2204. The user may press strings 2202 on fretboard 2204 by using fingers. Subsequently, a detector 2206 detects the contact and generates digital signals. In an embodiment of the invention, the digital signals are generated based on the positions of the contacts when the user strums strings 2202. For example, the user may press strings 2202 on fretboard 2204 with the fingers of the left hand and strum strings 2202 with the right hand.

Detector 2206 may include an electric circuit for detecting the contact. In an embodiment of the invention, strings 2202 and fretboard 2204 may be parts of the electric circuit. Therefore, when a string touches fretboard 2204 at a particular position, a voltage is induced and a digital signal is generated based on the position. In another embodiment of the invention, detector 2206 may include touch sensors for detecting the position of the contact. Examples of touch sensors include resistive touch sensors and capacitive touch sensors. In yet another embodiment of the invention, detector 2206 may include sensors such light sensors, motion sensors, temperature sensors and so forth. A person skilled in the art will appreciate that various other types of components and circuits may be used to detect the position of contact.

The position of contact may be designated in the signals by the string touching fretboard 2204 and the coordinates of the contact. Further, the signals may include information such as the time and duration of the contact. The signals are then transmitted to processing device 2106 by transmitter 2208 through a wired connection and/or a wireless connection. For example, transmitter 2208 may transmit the signals though a Universal Serial Bus (USB), Wifi, Bluetooth, Infrared, Ethernet ports and so forth. Thereafter, processing device 2106 may process the signals to generate musical notation.

Figure 23:
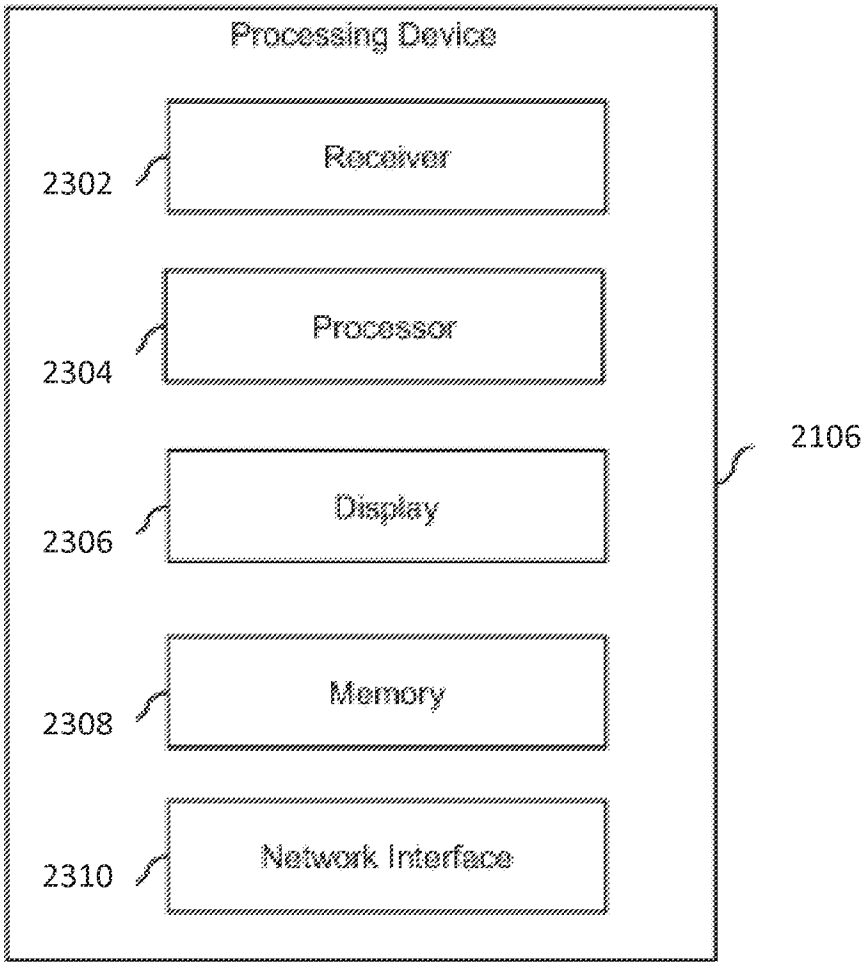
FIG. 23 illustrates elements of a processing device in accordance with some embodiments of the present technology.

With reference to FIG. 23, various elements of processing device 2106 are illustrated in accordance with an embodiment of the invention. The signals sent from transmitter 2208 are received by a receiver 2302 of processing device 2106. Subsequently, a processor 2304 analyzes the signals to generate musical notation. As discussed above, musical notation may be in the form of tablature. Further, the tablature may be a standard tablature of a hybrid tablature. The hybrid tablature may include the finger position and time or duration information of the contact. For example, the hybrid tablature may be in the form of a hybrid of a combination of a piano roll mechanism for duration information and tablature of note, pitch, fret, string information.

The tablature may be displayed on a Graphical User Interface (GUI) of a display 2306. In an embodiment of the invention, the positions are displayed on the GUI in real-time. For example, when at a particular moment the user presses the strings to contact the fretboard, the position is displayed on the GUI at the same moment in form of tablature. Display 2306 may be integrated in processing device 2106 or may be connected as an external device. In another embodiment of the invention, the tablature may be stored in a memory 2308. Examples of memory 2308 include but are not limited to a Random Access Memory (RAM), a Read Only Memory (ROM), a USB drive and so forth. Therefore, the user can view the tablature at a later moment based on the requirement. In yet another embodiment of the invention, the tablature may be simultaneously displayed in real time and stored in memory 2308. Further, the user may navigate through the tablature from display 2306 or print the tablature for a physical copy.

Processing device 2106 may include a network interface 2310 for communicating over network 2108. Processing device 2106 may communicate the tablature to remote devices 2110*a-n*. Further, the signals may be communicated to remote devices 2110*a-n*. In an embodiment of the invention, processing device 2106 may display the finger positions and other information over a pre-stored tablature in memory 2308 for comparison. As a result, the user can learn the finger placements based on the pre-stored tablature. Although processing device 2106 is discussed as an external device to instrument 2104, a person skilled in the art will appreciate that instrument 2104 may include all or parts of the functionalities of processing device 2106.

Figure 24:
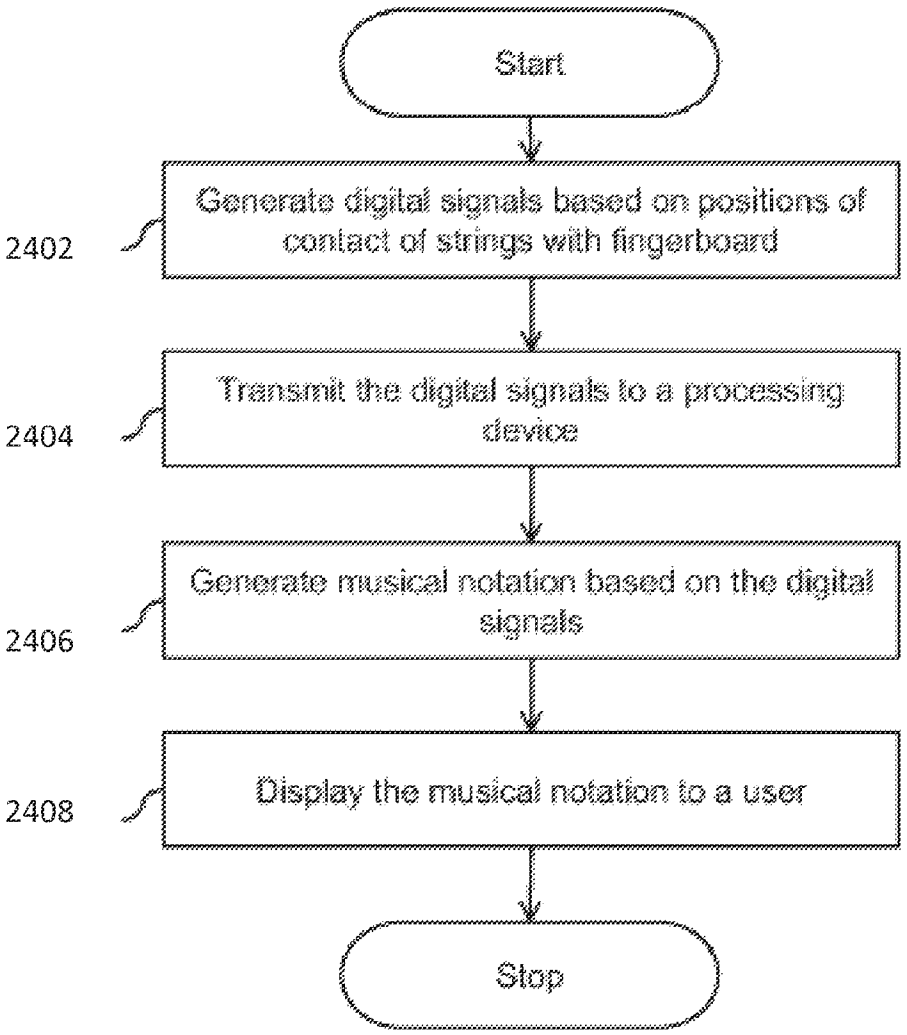
FIG. 24 is a flowchart for generating musical notation in accordance with some embodiments of the present technology.

FIG. 24 is a flowchart for generating musical notation in accordance with an embodiment of the invention. The user may interact with instrument 2104 by using strings 2202 and fretboard 2204. For example, the user may press a string with finger on fretboard 2204. Subsequently, at step 2402, digital signals are generated based on the positions associated with contacts of string on fretboard 2204. The digital signals may include the information regarding the position of the fingers and the time and/or duration of the contact. Thereafter, the signals are transmitted to processing device 2106, at step 2404. The signals may be transmitted over a wired connection and/or a wireless connection.

At step 2406, processing device 2106 analyzes the signals to generate musical notation. The musical notation may include tablature indicating the finger positions. Subsequently, the tablature may be displayed to the user on display 2306 at step 2408. Further, the tablature may be stored in a memory 2308 and then displayed on display 306. Moreover, processing device 2106 may communicate the signals containing the position information and/or the tablature over network 2108.

For example, as explained in greater detail below, the instrument can couple with an external host that runs an application for displaying note information and outputting corresponding audio when notes are played properly.

Updating and Scaling the Input Device

Figure 25:
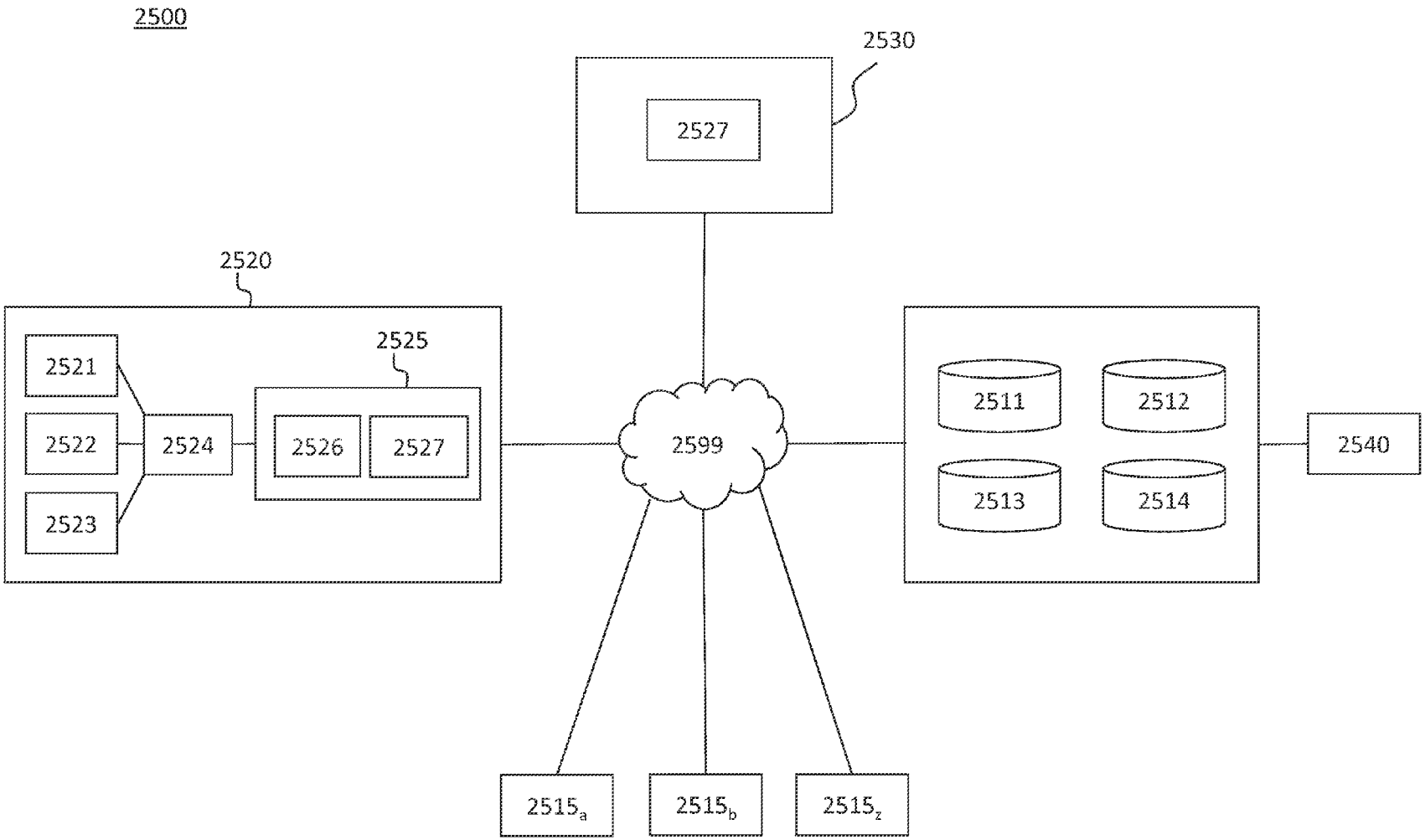
FIG. 25 illustrates a network ecosystem including a server in communication with an external host integrated into an input device via one or more network according to some embodiments of the present technology.

In some embodiments of the present technology, an input device can be integrated into a network ecosystem via an external host. FIG. 25 illustrates a network ecosystem 2500 including a server 2510 in communication with an external host 2525 integrated into an input device 2520 via one or more network 2599.

The input device 2520 can be an instrument (e.g. a guitar-like instrument) have a suspended-wire switch array circuit 2521, a wire contact detection circuit 2522 (e.g. a piezoelectric circuit), and a lighting controller 2523 electronically coupled with a control unit 2524. Also, the control unit 2524 can be electronically coupled with the external host 2525. Those with ordinary skill in the art having the benefit of this disclosure will readily appreciate that a wide variety of external hosts 2525 can be used with the disclosed technology. In a specific example, the external host 2525 can be a smartphone that is able to connect to the server 2510 via the one or more network 2599.

Also, the external host 2525 can include a display 2526 and can run an application 2527 configured to access content and user data from the server 2510 and configured to display information about the content on the display 2526. The application 2527 can be uploaded to an application store platform 2530 from the server 2510 and downloaded from the application store platform 2530 via the external host device. Similarly, updates to the application can be uploaded to the application store platform 2530 from the server 2510 and be made available for download.

The server 2510 can contain one or more content repositories 2511, 2512 containing content that is configured to be accessed via the application 2527. In some embodiments, the content stored in the one or more content repositories 2511, 2512 comprises song information in a tablature, piano roll, hybrid, etc. form. In some embodiments, access to the one or more content repositories 2511, 2512 is tiered. For example, all users of the application 2527 can have access to content in content repository 2511 while only premium (e.g. paying) users of the application 2527 can have access to content in content repository 2512.

The server 2510 can contain a user data repository 2513 containing user data such as usernames, passwords, preferences, etc. Also, the user data repository 2513 can store application song play data for users. Similarly, the application 2527 can access play data of one or more user (if the user has not opted out of sharing play data) and share the users' play data in the application 2527 or with another application. For example, the application 2527 can be configured to share users' play data in a social media application, micro-blogging application, etc.

The server 2510 can also be configured to receive updates from an administrator 2540. For example, the server 2510 can receive one or more updates to the application 2527 software and the server 2510 can upload the application updates to the application store platform 2530 or send them directly to the host device 2525. Similarly, the server 2510 can receive one or more software updates and/or firmware updates for the switch array circuit 2521, the wire contact detection circuit 2522, a lighting controller 2523, the control unit 2524, or combinations thereof. The server 2510 can upload the software/firmware updates to the application store platform 2530 or directly to the host device 2525.

Also, in some embodiments of the present technology, one or more of the switch array circuit 2521, the wire contact detection circuit 2522, a lighting controller 2523, and the control unit 2524 are configured to be removable and replaceable. Consequently, if an administrator 2540 updates one or more of the hardware components, a user can easily swap out existing components with new, updated ones. For example, in some embodiments, the control unit 2524 is modular, replaceable, and contains a digital signal-processing module for processing an analog voltage signal coming from the wire contact detection circuit 2522. Upon an update being made available to the signal-processing software, firmware, or hardware (e.g. an updated crosstalk processing software patch) of the control unit 2524, the control unit 2524 can simply be removed and replaced by the end user. Similarly, the input device 2520 can include one or more expansion slots (not shown) electronically coupled to the control unit 2524 for accommodating future modules, now known or later developed. Accordingly, the input device 2520 is extremely scalable and expandable.

The server 2510 can also include a developer toolbox 2514. The developer toolbox can be used to store and make available to developers $\mathbf{2515}_{a\text{-}n}$, tools for creating software application, as well as firmware and hardware modifications, for the host device 2525 and/or the input device 2520. The developer tools can comprise a software developer kit (SDK) containing information required to program applications for the host device 2525 to control the input device 2520. For example, the SDK can include one or more downloadable application programming interfaces (APIs) that can be used to create software applications that can interact with the application 2527, the host device 2520 itself, or both.

Software and User Interface Elements

The disclosed system can detect and process inputs as notes, detect motion, drive lighting elements, display information on an external host device, output audio, receive note information from a server, etc. The variety of inputs and output options lends to a wide variety of ways to present the information to a user. For example, in the case of the input device being used as a musical device, the external host can operate software for teaching a user to play the musical instrument. Also, the software can receive song information form the server, output an audio signal that conveys how the song is meant to be played, cause the input device to light up lighting elements showing proper finger placement, etc. FIGS. 26A through 26D illustrate exemplary user interface elements for instructing a user to play a musical instrument according to some embodiments of the present technology.

Figure 26B:
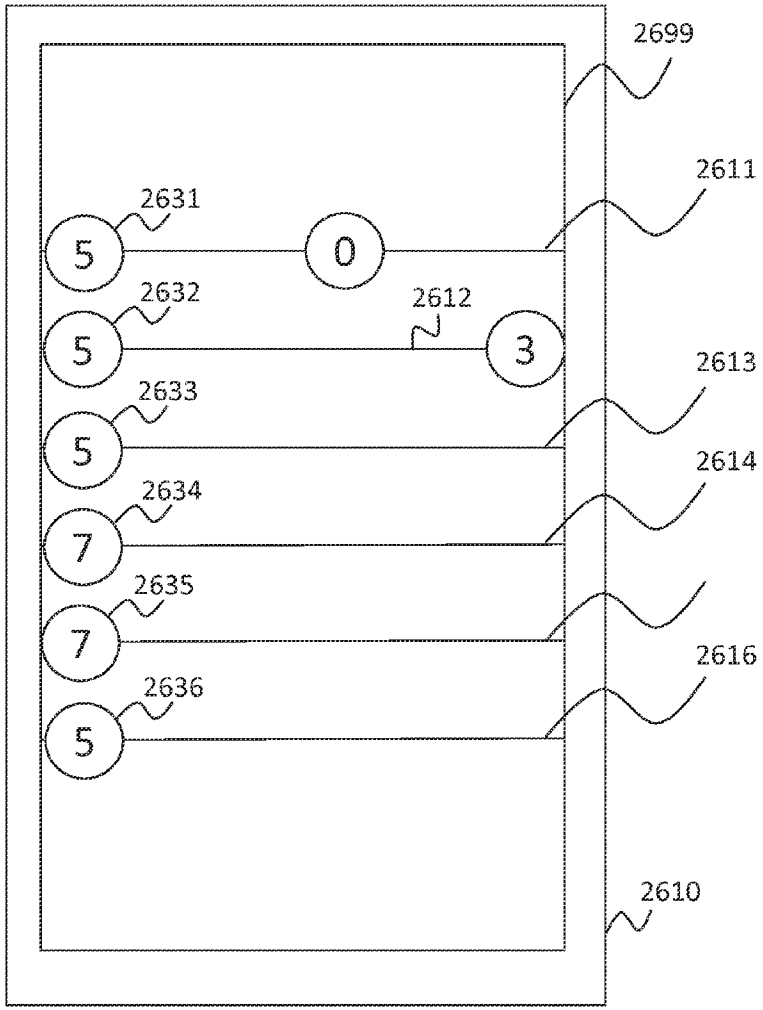
FIG. 26B illustrates the representation of music composition of FIG. 26A when notes or chords are played satisfactorily according to some embodiments of the present technology.
Figure 26A:
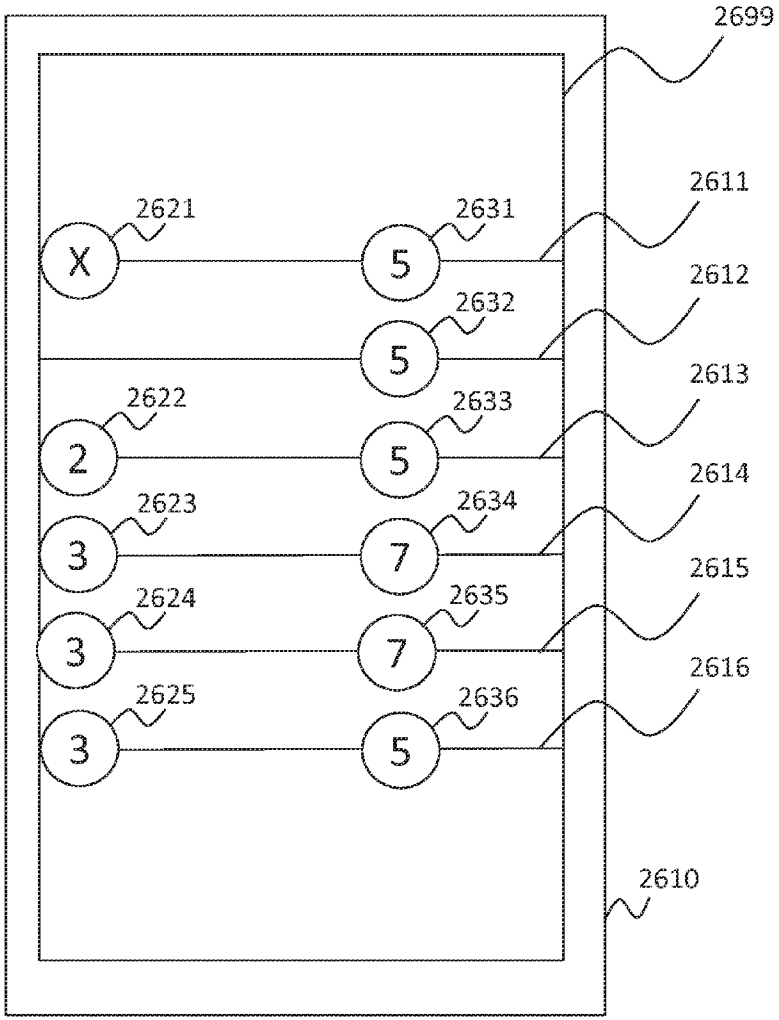
FIG. 26A illustrates an exemplary representation of music composition displayed an external device electronically coupled with an input device according to some embodiments of the present technology.

FIG. 26A illustrates an exemplary display 2610 of an external device electronically coupled with an input device. The display 2610 shows a representation 2699 of music composition with an array of strings 2611, 2612, 2613, 2614, 2615, 2616 representing the wires on the input device and a plurality of finger placement description elements 2621, 2622, 2623, 2624, 2625, 2631, 2632, 2633, 2634, 2635, 2636 that describe which string/fret combination to play with an "0" or "X" being used to indicate that an open string should be plucked or played in a chord. The representation 2699 of music composition is also configured to move along as correct notes are played according to rules described below. As shown in FIGS. 26A and 26B, the left-hand side of the representation 2699 shows the current note/chord to be played and the representation 2699 moves from right to left when the rule is satisfied (e.g. when the note/chord is played satisfactorily).

Figure 26C:
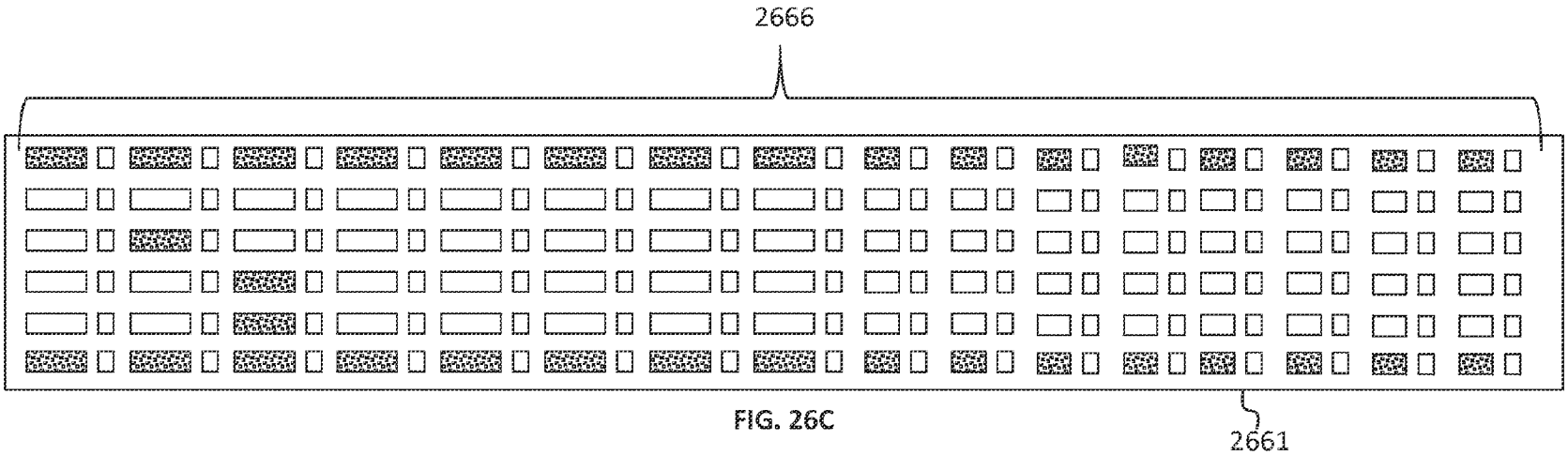
FIG. 26C illustrates a neck of an input device having an array of lighting elements showing finger placement and string information according to some embodiments of the present technology.

Additionally, external device can cause the input device to change state (e.g. toggles lighting elements) according to how a song should be played. FIG. 26C illustrates a neck 2661 of an input device having an array of lighting elements 2666. Particular lighting elements can be illuminated to show the proper string/fret combination for playing the music composition shown in the display. The illuminated lighting elements and correspond with the information being described in the representation 2699 of FIG. 26A.

An entire row of lighting elements can be illuminated to indicate that an open string should be played. Additionally, the LEDs can be RGB LEDs such that each row of lighting elements under a particular string can be a different color.

Figure 26D:
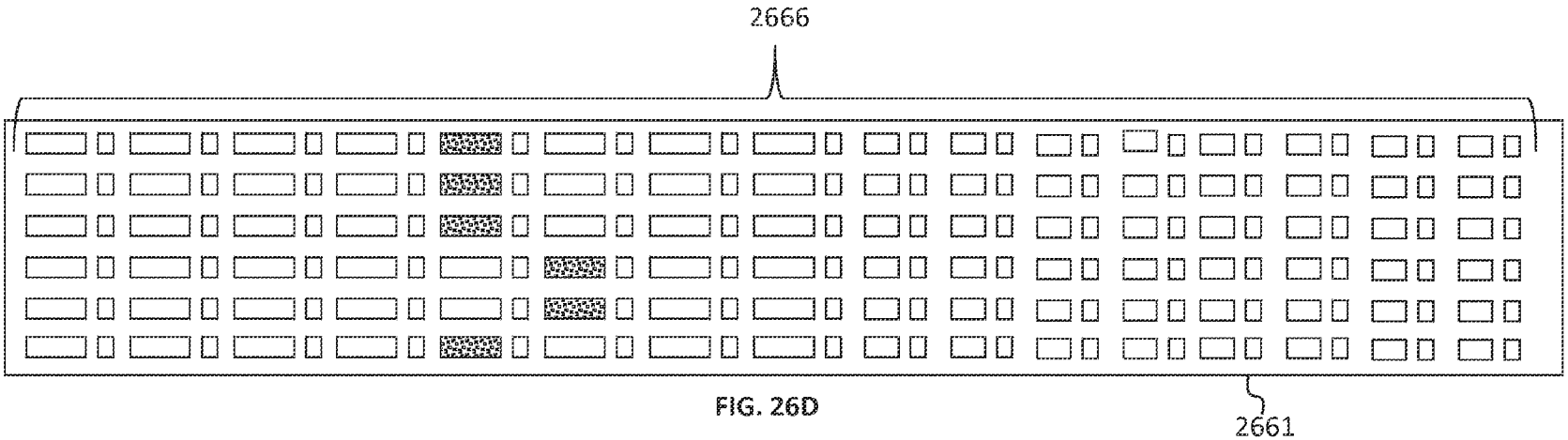
FIG. 26D illustrates a neck of an input device having an array of lighting elements showing finger placement and string information according to some embodiments of the present technology.

FIG. 26B illustrates the representation 2699 of music composition when the notes/chords described in FIG. 26A are played satisfactorily. As shown, the representation moved on to the next set of finger placement description elements 2631, 2632, 2633, 2634, 2635, 2636. Likewise, other finger placement description elements 2641, 2651 are exposed to show further note information for later in the composition. Similarly, FIG. 26D illustrates the neck 2630 of the input device when the notes/chords described in FIG. 26A and FIG. 26C are played satisfactorily.

As explained above, the representation of the music composition can advance when the notes/chords are played satisfactorily. FIG. 27 illustrates an exemplary set of rules according to some embodiments of the present technology. As shown in FIG. 27, three sets of rule modes include "Easy," "Medium," and "Hard." Each rule mode can require one or more type of correct input to advance the music composition. The types of inputs can correspond to one or more portion of the hardware in the input device. Also, depending on the rule mode, the device can either play incorrect notes or not.

Computing Environment

Figure 28A:
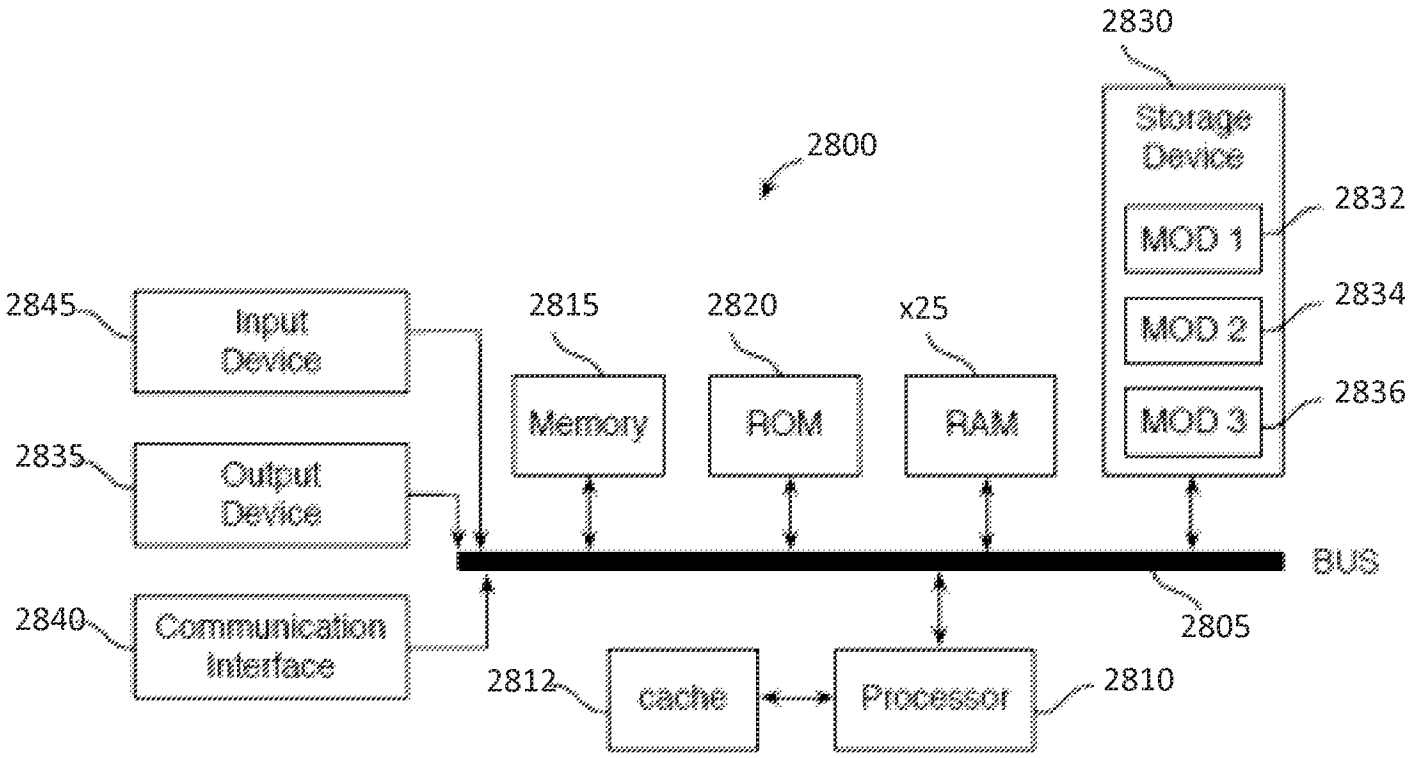
FIG. 28A and FIG. 28B illustrate exemplary possible system embodiments.
Figure 28B:
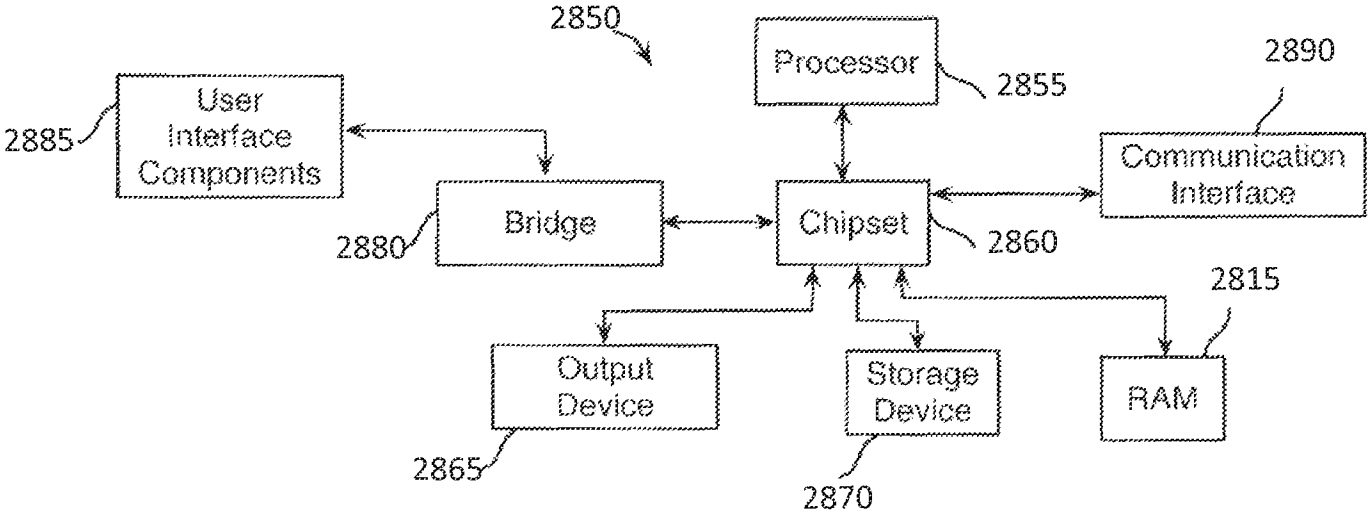

FIG. 28A and FIG. 28B illustrate exemplary possible system embodiments. The more appropriate embodiment will be apparent to those of ordinary skill in the art when practicing the present technology. Persons of ordinary skill in the art will also readily appreciate that other system embodiments are possible.

FIG. 28A illustrates a conventional system bus computing system architecture 2800 wherein the components of the system are in electrical communication with each other using a bus 2805. Exemplary system 2800 includes a processing unit (CPU or processor) 2810 and a system bus 2805 that couples various system components including the system memory 2815, such as read only memory (ROM) 2820 and random access memory (RAM) 2825, to the processor 2810. The system 2800 can include a cache of high-speed memory connected directly with, in close proximity to, or integrated as part of the processor 2810. The system 2800 can copy data from the memory 2815 and/or the storage device 2830 to the cache 2812 for quick access by the processor 2810. In this way, the cache can provide a performance boost that avoids processor 2810 delays while waiting for data. These and other modules can control or be configured to control the processor 2810 to perform various actions. Other system memory 2815 may be available for use as well. The memory 2815 can include multiple different types of memory with different performance characteristics. The processor 2810 can include any general purpose processor and a hardware module or software module, such as module 1 2832, module 2 2834, and module 3 2836 stored in storage device 2830, configured to control the processor 2810 as well as a special-purpose processor where software instructions are incorporated into the actual processor design. The processor 2810 may essentially be a completely self-contained computing system, containing multiple cores or processors, a bus, memory controller, cache, etc. A multi-core processor may be symmetric or asymmetric.

To enable user interaction with the computing device 2800, an input device 2845 can represent any number of input mechanisms, such as a microphone for speech, a touch-sensitive screen for gesture or graphical input, keyboard, mouse, motion input, speech and so forth. An output device 2835 can also be one or more of a number of output mechanisms known to those of skill in the art. In some instances, multimodal systems can enable a user to provide multiple types of input to communicate with the computing device 2800. The communications interface 2840 can generally govern and manage the user input and system output. There is no restriction on operating on any particular hardware arrangement and therefore the basic features here may easily be substituted for improved hardware or firmware arrangements as they are developed.

Storage device 2830 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 2825, read only memory (ROM) 620, and hybrids thereof.

The storage device 2830 can include software modules 2832, 2834, 2836 for controlling the processor 2810. Other hardware or software modules are contemplated. The storage device 2830 can be connected to the system bus 2805. In one aspect, a hardware module that performs a particular function can include the software component stored in a computer-readable medium in connection with the necessary hardware components, such as the processor 2810, bus 2805, display 2835, and so forth, to carry out the function.

FIG. 28B illustrates a computer system 2850 having a chipset architecture that can be used in executing the described method and generating and displaying a graphical user interface (GUI). Computer system 2850 is an example of computer hardware, software, and firmware that can be used to implement the disclosed technology. System 2850 can include a processor 2855, representative of any number of physically and/or logically distinct resources capable of executing software, firmware, and hardware configured to perform identified computations. Processor 2855 can communicate with a chipset 2860 that can control input to and output from processor 2855. In this example, chipset 2860 outputs information to output 2865, such as a display, and can read and write information to storage device 2870, which can include magnetic media, and solid state media, for example. Chipset 2860 can also read data from and write data to RAM 2875. A bridge 2880 for interfacing with a variety of user interface components 2885 can be provided for interfacing with chipset 2860. Such user interface components 2885 can include a keyboard, a microphone, touch detection and processing circuitry, a pointing device, such as a mouse, and so on. In general, inputs to system 2850 can come from any of a variety of sources, machine generated and/or human generated.

Chipset 2860 can also interface with one or more communication interfaces 2890 that can have different physical interfaces. Such communication interfaces can include interfaces for wired and wireless local area networks, for broadband wireless networks, as well as personal area networks. Some applications of the methods for generating, displaying, and using the GUI disclosed herein can include receiving ordered datasets over the physical interface or be generated by the machine itself by processor 2855 analyzing data stored in storage 2870 or 2875. Further, the machine can receive inputs from a user via user interface components 2885 and execute appropriate functions, such as browsing functions by interpreting these inputs using processor 2855.

It can be appreciated that exemplary systems 2800 and 2850 can have more than one processor 2810 or be part of a group or cluster of computing devices networked together to provide greater processing capability.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can comprise hardware, firmware and/or software, and can take any of a variety of form factors. Typical examples of such form factors include laptops, smart phones, small form factor personal computers, personal digital assistants, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are means for providing the functions described in these disclosures.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

The various embodiments described above are provided by way of illustration only and should not be construed to limit the scope of the disclosure. Those skilled in the art will readily recognize various modifications and changes that may be made to the principles described herein without following the example embodiments and applications illustrated and described herein, and without departing from the spirit and scope of the disclosure.

I claim:

1. A method of registering inputs in a stringed input device comprising:

detecting, with a first sensor, a vibration in a first string;

detecting, with a second sensor, a vibration in a second string that is caused by a mechanical coupling of the vibration of the first string with the second string;

determining a thresholding ratio describing a degree to which the vibration in the first string caused the vibration in the second string;

detecting a subsequent vibration in the first string and a subsequent vibration in the second string;

determining whether an amplitude of the subsequent vibration in the second string is greater than a dynamic threshold amplitude that is a function of the amplitude of the subsequent vibration of the first string and the thresholding ratio.

2. The method of registering inputs in a stringed input device of claim 1, further comprising:

passing zero signal to a processor when the amplitude of the subsequent vibration of the second string is less than the dynamic threshold amplitude.

3. The method of registering inputs in a stringed input device of claim 1, further comprising:

registering, in a processor, the subsequent vibration of the second string as an input when the amplitude of the subsequent vibration of the second string is greater than the dynamic threshold amplitude.

4. The method of registering inputs in a stringed input device of claim 3, wherein detecting the subsequent vibration in the first string further comprises:

detecting that the amplitude of the subsequent vibration of the first string has increased to a degree to which the amplitude of the subsequent vibration of the second string is no longer greater than the dynamic threshold amplitude; and sending, to the processor, a cancel signal for canceling the registration of the subsequent vibration of the second string as an input.

5. The method of registering inputs in a stringed input device of claim 1, further comprising opening a time window to monitor the subsequent vibration in the first string and the subsequent vibration in the second string.

6. The method of registering inputs in a stringed input device of claim 5, further comprising:

detecting a peak amplitude of the first string within the window; and wherein determining whether an amplitude of the subsequent vibration in the second string is greater than a dynamic threshold amplitude comprises determining whether the amplitude of the subsequent vibration in the second string is greater than the dynamic threshold amplitude.

7. An input device comprising:

an array of strings suspended between a head and a bridge;

a detection circuit electronically coupled with the strings and configured to detect vibrations in the strings, wherein the detection circuit comprises a piezoelectric sensor coupled with each string, wherein each piezoelectric sensor produces a voltage signal having an amplitude;

a memory device configured to store a thresholding ratio describing a degree to which the vibration in the first string caused the vibration in the second string;

wherein the detection circuit is further configured to detect a subsequent vibration in the first string and a subsequent vibration in the second string; and a processor configured to determine whether the amplitude of the subsequent vibration in the second string is greater than a dynamic threshold amplitude that is a function of subsequent amplitude of the first string and the thresholding ratio.

8. The input device of claim 7, wherein the processor is further configured to:

receive, from the detection circuit, a voltage signal representing a calibration vibration of a first string in the array of strings;

receive, from the detection circuit, a cross talk calibration voltage signal representing vibration of a second string in the array of strings that is caused by mechanical coupling of the vibration of the first string with the second string; and store a thresholding ratio describing the degree to which the calibration vibration in the first string caused the cross talk calibration vibration in the second string.

9. The input device of claim 7, further comprising:

a register configured to accept a vibration input from the processor when the amplitude of the subsequent vibration in the second string is greater than a dynamic threshold amplitude that is a function of subsequent amplitude of the first string and the thresholding ratio; and a trigger detection processor configured to interpret the vibration input as a musical note.

10. The input device of claim 9, wherein the processor is further configured to pass zero signal to the register when the amplitude of the subsequent vibration of the second string is less than the dynamic threshold amplitude.

11. The input device of claim 9, wherein the processor is further configured to:

receive a signal describing that the amplitude of the subsequent vibration of the first string has increased to a degree to which the amplitude of the subsequent vibration of the second string is no longer greater than the dynamic threshold amplitude; and send, to the register, a cancel signal for canceling the registration of the subsequent vibration of the second string as an input.

12. The input device of claim 7, wherein the processor is further configured to open a time window to monitor the subsequent vibration in the first string and the subsequent vibration in the second string.

13. The input device of claim 12, wherein the processor is further configured to:

detecting a peak amplitude of the first string within the window; and wherein determining whether an amplitude of the subsequent vibration in the second string is greater than a dynamic threshold amplitude comprises determining whether the amplitude of the subsequent vibration in the second string is greater than the dynamic threshold amplitude.

14. The input device of claim 7, wherein the array of strings is suspended over an array of contacts, and wherein the input device further comprises:

a string contact detection circuit electronically coupled with the strings and with the contacts and configured to detect string contact between strings in the array of strings and contacts in the array of contacts.

15. The input device of claim 14, wherein the string contact detection circuit is electronically coupled with the processor, wherein the processor is configured to receive string contact information, and wherein the processor is further configured to interpret the vibration input and the string contact information as a string down event.

16. A non-transitory computer-readable storage medium comprising:

a medium configured to store computer-readable instructions thereon; and the computer-readable instructions that, when executed by a processing device cause the processing device to perform a method, comprising:

detecting, with a first sensor, a vibration in a first string;

detecting, with a second sensor, a vibration in a second string that is caused by a mechanical coupling of the vibration of the first string with the second string;

determining a thresholding ratio describing a degree to which the vibration in the first string caused the vibration in the second string;

detecting a subsequent vibration in the first string and a subsequent vibration in the second string;

determining whether an amplitude of the subsequent vibration in the second string is greater than a dynamic threshold amplitude that is a function of the subsequent amplitude of the first string and the thresholding ratio.

17. The non-transitory computer-readable storage medium of claim 16, the instructions further causing the processing device to perform the steps of:

passing zero signal to a processor when the amplitude of the subsequent vibration of the second string is less than the dynamic threshold amplitude.

18. The non-transitory computer-readable storage medium of claim 16, the instructions further causing the processing device to perform the steps of:

registering, in a processor, the subsequent vibration of the second string as an input when the amplitude of the subsequent vibration of the second string is greater than the dynamic threshold amplitude.

19. The non-transitory computer-readable storage medium of claim 16, wherein detecting the subsequent vibration in the first string further comprises:

detecting that the amplitude of the subsequent vibration of the first string has increased to a degree to which the amplitude of the subsequent vibration of the second string is no longer greater than the dynamic threshold amplitude; and sending, to the processor, a cancel signal for canceling the registration of the subsequent vibration of the second string as an input.

20. The non-transitory computer-readable storage medium of claim 16, the instructions further causing the processing device to perform the steps of:

opening a time window to monitor the subsequent vibration in the first string and the subsequent vibration in the second string;

detecting a peak amplitude of the first string within the window; and wherein determining whether an amplitude of the subsequent vibration in the second string is greater than a dynamic threshold amplitude comprises determining whether the amplitude of the subsequent vibration in the second string is greater than the dynamic threshold amplitude.

* * * * *